US008500124B1

(12) United States Patent
Reidhaar

(10) Patent No.: US 8,500,124 B1
(45) Date of Patent: Aug. 6, 2013

(54) MEDIA ACTUATED MEDIA DIVERTER FOR AN IMAGING DEVICE

(71) Applicant: Lexmark International, Inc., Lexington, KY (US)

(72) Inventor: Glenn Alan Reidhaar, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 13/731,677

(22) Filed: Dec. 31, 2012

(51) Int. Cl.
*B65H 29/58* (2006.01)

(52) U.S. Cl.
CPC ..... *B65H 29/58* (2013.01)
USPC ..... 271/303; 271/186; 271/291; 271/301; 399/401

(58) Field of Classification Search
USPC ..... 271/186, 291, 301, 303; 399/401, 399/405, 364
See application file for complete search history.

(56) References Cited

U.S. PATENT DOCUMENTS 7,789,388 B2 * 9/2010 Matsubara et al. ..... 271/303
2001/0036379 A1 * 11/2001 Takahashi et al. ..... 399/401

FOREIGN PATENT DOCUMENTS

JP 05294532 A * 11/1993

* cited by examiner

*Primary Examiner* — Gerald McClain
(74) *Attorney, Agent, or Firm* — John Victor Pezdek

(57) ABSTRACT

A media actuated, media diverter mounted on a guide member positioned between the output of a simplex path and the entrance of a duplex path in an imaging device. The media diverter comprises a first plate, a biasing member for biasing the first plate in a first position where the first plate extends into the duplex path, and a second plate having a media guiding surface and a center of gravity biasing the second plate in a first position where the media guiding surface extends into the simplex path. First plate and second plate are movable in a slot through the guide member. With the first plate in its first position, the second plate remains movable between from its first and second positions. A media sheet fed into the duplex path moves first plate to its second position blocking movement of the second plate from its first position.

26 Claims, 14 Drawing Sheets

MEDIA ACTUATED MEDIA DIVERTER FOR AN IMAGING DEVICE

CROSS REFERENCES TO RELATED APPLICATIONS

This application is a continuation of U.S. patent application Ser. No. 13/218,372, entitled "Media Actuated Media Diverter For An Imaging Device" filed Aug. 25, 2011. This application is related to U.S. patent application Ser. No. 13/218,386, entitled "Media Actuated Media Diverter For An Imaging Device" filed Aug. 25, 2011, and assigned to the assignee of this application.

STATEMENT REGARDING FEDERALLY SPONSORED RESEARCH OR DEVELOPMENT

None.

REFERENCE TO SEQUENTIAL LISTING, ETC.

None.

BACKGROUND

1. Field of the Disclosure

The present application relates generally to an imaging device and more particularly to a diverter gate for directing media along a media path, the diverter gate operable by the media being fed along the media path of the imaging device.

2. Description of the Related Art

In the imaging process used in imaging devices such as printers, copiers, and automatic document feed scanners, a series of rolls and/or belts advance media from a media storage location along a media path through an image transfer section or scanning section of the device. Image transfer may be achieved through the use of a photosensitive member such as a photosensitive drum or belt, a thermal inkjet device, a piezo-electric inkjet device, dye sublimation or any other image forming technology. The media is then advanced through an exit path to an output location for collecting the media.

The exit path may include one or more exit nips. For example, some devices include a pair of exit nips formed by three exit rolls. In operation, the top and bottom rolls rotate in the same direction while the middle roll rotates in the opposite direction. Accordingly, when the top nip rotates inward, the bottom nip rotates outward and vice versa. A first exit (top) nip may be used to partially exit and then reenter a media sheet into the imaging device. Upon reentry, the media sheet is advanced through a duplex path in order to permit image transfer or scanning of a reverse side of the media sheet. This is known as a "peek-a-boo" duplex operation. A second exit (bottom) nip may be used to deliver finished media to the output area. The three exit rolls may share a common drive linkage. In this configuration, while a media sheet is partially exiting the imaging device during a peek-a-boo duplex operation, the second exit nip rotates inward. A motor driven diverter gate and gear linkage is used to direct the media between the first and second exit nips. It would be advantageous to be able to eliminate the expense of the motor driven diverter gate with a diverter gate actuated by the media moving along the media path.

SUMMARY

A media actuated, media diverter mountable on a guide member for a media sheet in a media path of an imaging device and an imaging device using the same is disclosed. The media path has a simplex path and a duplex path with the media guide member positioned between an exit of the simplex path and an entrance of the duplex path and an exit of the imaging device. The media diverter comprises a first plate having a media contact surface along a first portion of an edge of the plate and a first abutment surface along a second portion of the edge, a biasing member for biasing the first plate, and a second plate having a media guiding surface along a first portion of an edge of the second plate and a second abutment surface along a second portion of the edge. The first plate and second plate are sized to be movable in a slot through the guide member between respective first and second positions, such that the first plate when in its first position the media contact surface thereof extends into the duplex path and the second plate when in its first position the media guiding surface thereof extends into the simplex path while the second plate remains movable from its first position. The first plate and second plate are biasable in their respective first positions. When a media sheet fed into the duplex path contacts the media contact surface actuating the media diverter to move the first plate to the second position the abutment surface thereof moves into its second position adjacent the abutment surface of the second plate blocking the movement of the second plate from its first position with the media guiding surface of the second plate directing a following media sheet in the simplex path to the exit of the imaging device.

In a further form the second plate has a center of gravity offset from a vertical centerline of the pivot hole for biasing the second plate in the first position. In another form the first or second plate may have a trunnion mount. One of the trunnions of the first plate may have a spring mounted thereon for biasing the first plate in the first position.

In a still further form, a support member interconnecting with each first plate in the plurality of plates may be provided. The support member mounted adjacent the media contact surface and a biasing member may be positioned between the support member and the guide member to bias the first plates of the media diverter in the first position.

BRIEF DESCRIPTION OF THE DRAWINGS

The above-mentioned and other features and advantages of the various embodiments, and the manner of attaining them, will become more apparent and will be better understood by reference to the accompanying drawings.

FIG. 7A illustrates a trunnion mount while FIG. 7B illustrates an alternative arrangement of the first and second fingers of a plate.

DETAILED DESCRIPTION

Figure 1B:
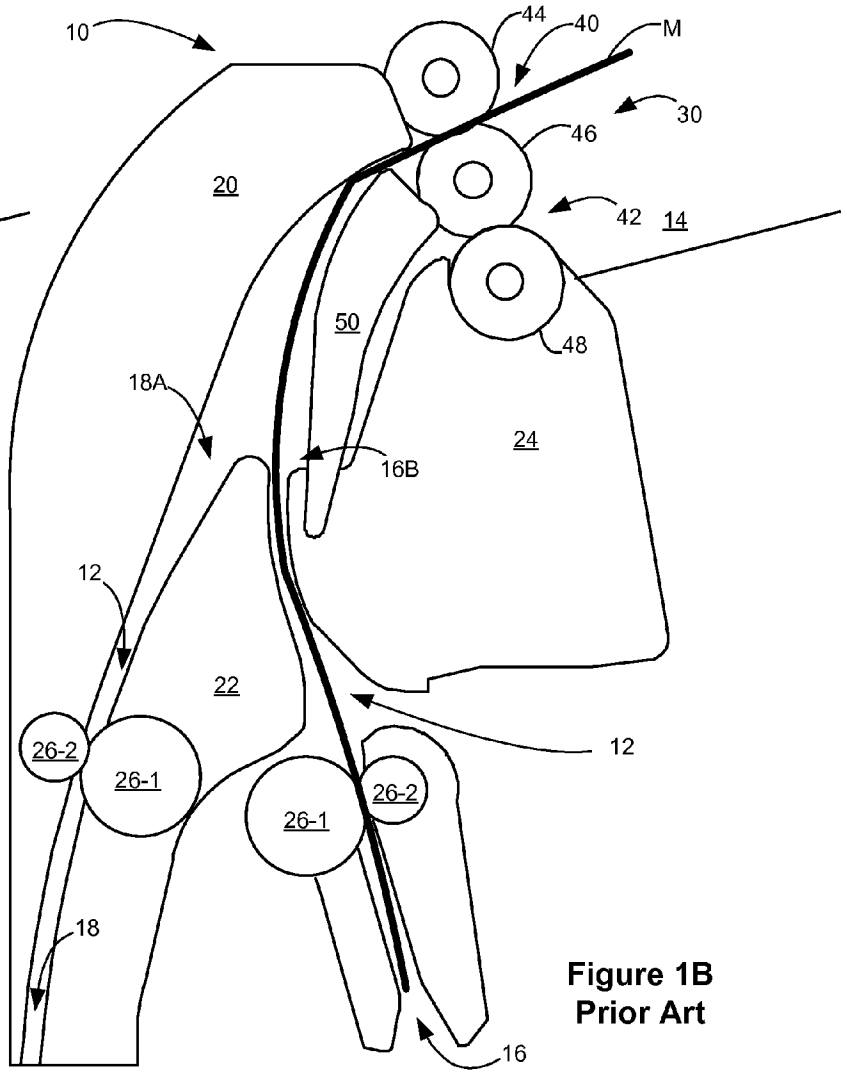
Figure 1B Prior Art
FIGS. 1A, 1B schematically show a prior art media diverter and exit path assembly.

The following description and drawings illustrate embodiments sufficiently to enable those skilled in the art to practice it. It is to be understood that the disclosure is not limited to the details of construction and the arrangement of components set forth in the following description or illustrated in the drawings. The invention is capable of other embodiments and of being practiced or of being carried out in various ways. For example, other embodiments may incorporate structural, chronological, electrical, process, and other changes. Examples merely typify possible variations. Individual components and functions are optional unless explicitly required, and the sequence of operations may vary. Portions and features of some embodiments may be included in or substituted for those of others. The scope of the application encompasses the appended claims and all available equivalents. The following description is, therefore, not to be taken in a limited sense, and the scope of the present invention is defined by the appended claims.

Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

Figure 1A:
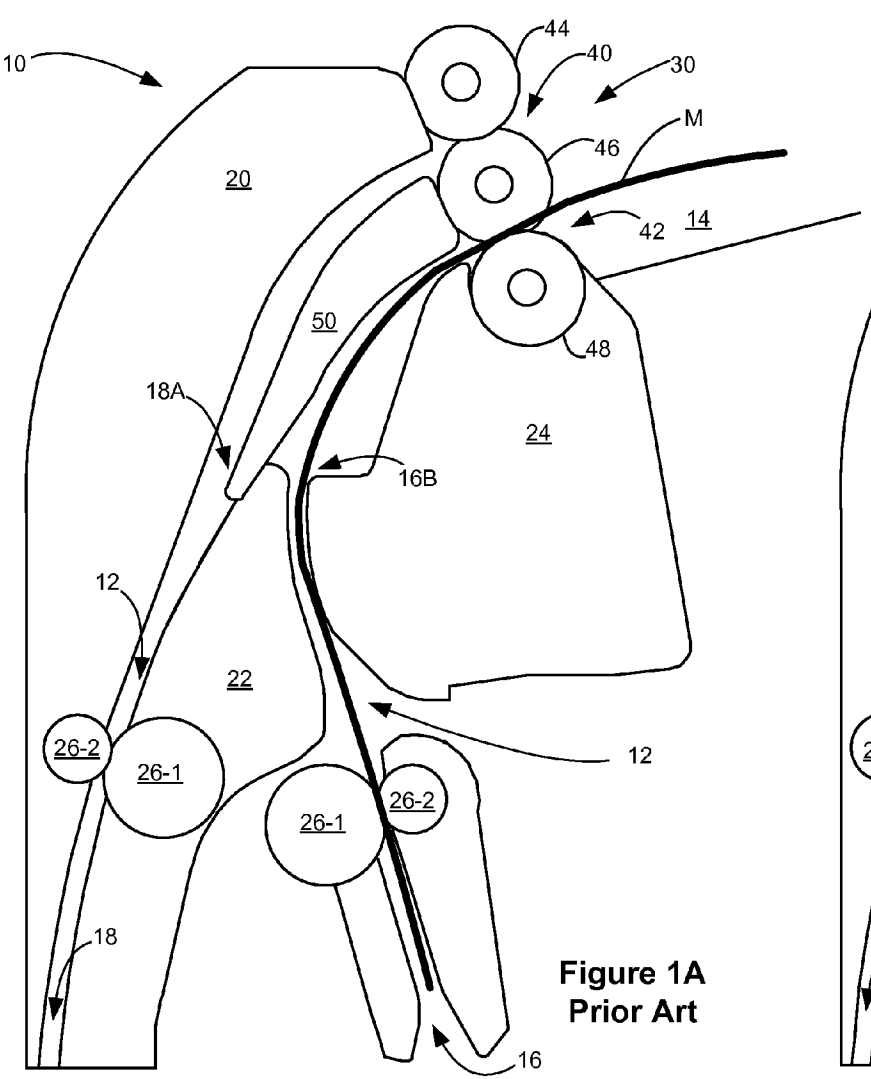
Figure 1A Prior Art

FIGS. 1A, 1B illustrate a partial view of the media path of a prior art imaging device 10 adjacent the media path exit. A media path 12 extends through the imaging device 10 for moving the media sheets from an input area through an imaging area where an image is transferred to the media sheet and then to an output area 14. The media path 12 includes a simplex path 16 and a duplex path 18 formed between one or more guide members 20, 22, 24 within imaging device 10. Guide members 20, 22, 24 may have a plurality of parallel ribs (not shown) projecting into the media path 12 to guide the media sheet M as it moves along the media path 12. Guide member 20 may be formed in a cover of imaging device 10. Guide members 20, 22, 24 may be rotatable or moveable to allow for access into the media path 12 to clear media sheets that have jammed. Guide member 22 forms a portion of both simplex path 16 and duplex path 18 near duplex path entrances 18A and simplex path exit 16B and is positioned between guide members 20, 24. A media sheet M is introduced into to the simplex path 16 from the input area by a feed mechanism such as a pick mechanism (not shown). The media sheet M is then moved along the media path 12 by one or more pairs of transport rolls 26-1, 26-2 one of which is a driven roll, for example transport roll 26-1, and one of which is an idler roll, for example transport roll 26-2.

After passing through an image transfer section in which the media may be scanned or printed as is known in the art, the media sheet M is advanced to the exit path assembly 30. The exit path assembly 30 includes a first exit nip 40 and a second exit nip 42. First exit nip 40 is formed by a first roll 44 and a second roll 46, and second exit nip 42 is formed by the second roll 46 and a third roll 48. The rotational direction of the first roll 44 and the third roll 48 are the same while the second roll 46 rotates in the opposite direction. Accordingly, the rotational direction of the first exit nip 40 is opposite that of the second exit nip 42. In the example embodiment illustrated, the first exit nip 40 is the top nip and the second exit nip 42 is the bottom nip. Alternative embodiments include those wherein this configuration is reversed such that the first exit nip 40 is the bottom nip and the second exit nip 42 is the top nip. As is convention, transport rolls 26-1, 26-2, and first, second, and third rolls 44, 46, 48 are shown as overlapping to indicate an interference fit as is known in the art.

A moveable diverter, or gate 50, is positioned between an exit 16B of the simplex path 16, the entrance 18A of the duplex path, and the first and second exit nips 40, 42 of exit path assembly 30. Diverter 50 is driven between two positions for directing the media sheet M to either the first exit nip 40 or the second exit nip 42. Where imaging or scanning of the reverse side of the media sheet is not desired, the diverter 50 is positioned to direct the media sheet toward the second exit nip 42 for exiting the media sheet into the output area 14 shown in FIG. 1A and blocking its movement toward first exit nip 40. Ribs 54 gently curve the media sheet toward second exit nip 42. Conversely, where imaging or scanning of a reverse side of the media sheet M is desired, the diverter 50 is driven counter-clockwise as illustrated in FIG. 1B closing off the portion of the media path 12 leading to second exit nip 42. Media sheet M is driven into the portion of the media path 12 leading to the first exit nip 40 for performing a peek-a-boo duplex operation. The media sheet M is partially exited into the output area 14 by the first exit nip 40 until a trailing edge of the media sheet M clears exit 16B of simplex path 16 and an entrance 18A of the duplex path 18. The rotation of the first exit nip 40 is then reversed to have the media sheet M enter into the entrance 18A to the duplex path 18. The media sheet M is then advanced through the duplex path 18 by a series of transport rolls, such as rolls 26-1, 26-2, until it reaches an exit of the duplex path 18 where it is reintroduced into the simplex path 16 for image transfer or scanning of the reverse side of the media sheet M. The media sheet M is then advanced back toward the diverter 50 which has been rotated clockwise as shown to close off the media path to first exit nip 40 and to direct the media sheet M toward the second exit nip 42 which outputs the duplexed media sheet into the output area 14.

Because the second exit nip 42 rotates inward as the first exit nip 40 rotates outward, the imaging device 10 is able to output a finished media sheet from the second exit nip 42 and perform a peek-a-boo duplex operation using the first exit nip 40 simultaneously. For example, where it is desired to perform duplex imaging on consecutive media sheets, a first media sheet is advanced along the simplex path 16 through the image transfer section. The diverter 50 directs the first media sheet into the first exit nip 40 where it is partially exited from the imaging device 10 by the outward rotation of the first exit nip 40 and then reentered into the imaging device 10 and into the duplex path 18 by the inward rotation of the first exit nip 40. As the first media sheet is advanced into and along the duplex path 18, a second media sheet is advanced along the simplex path 16 through the image transfer section. The diverter 50 directs the second media sheet into the first exit nip 40 where it is partially exited by the outward rotation of the first exit nip 40. As the second media sheet is advanced into and through the first exit nip 40, the first media sheet is advanced from the duplex path 18 back through the simplex path 16 to receive an image on the reverse side of the first media sheet. The second media sheet is then reentered into the imaging device 10 and into the duplex path 18 by the inward rotation of the first exit nip 40. As the second media sheet reenters the imaging device 10, the diverter 50 is positioned to direct the first media sheet into the second exit nip 42 where it is exited from the imaging device 10 into the output area 14. This process continues until all desired media sheets have received duplex imaging.

Figure 2:
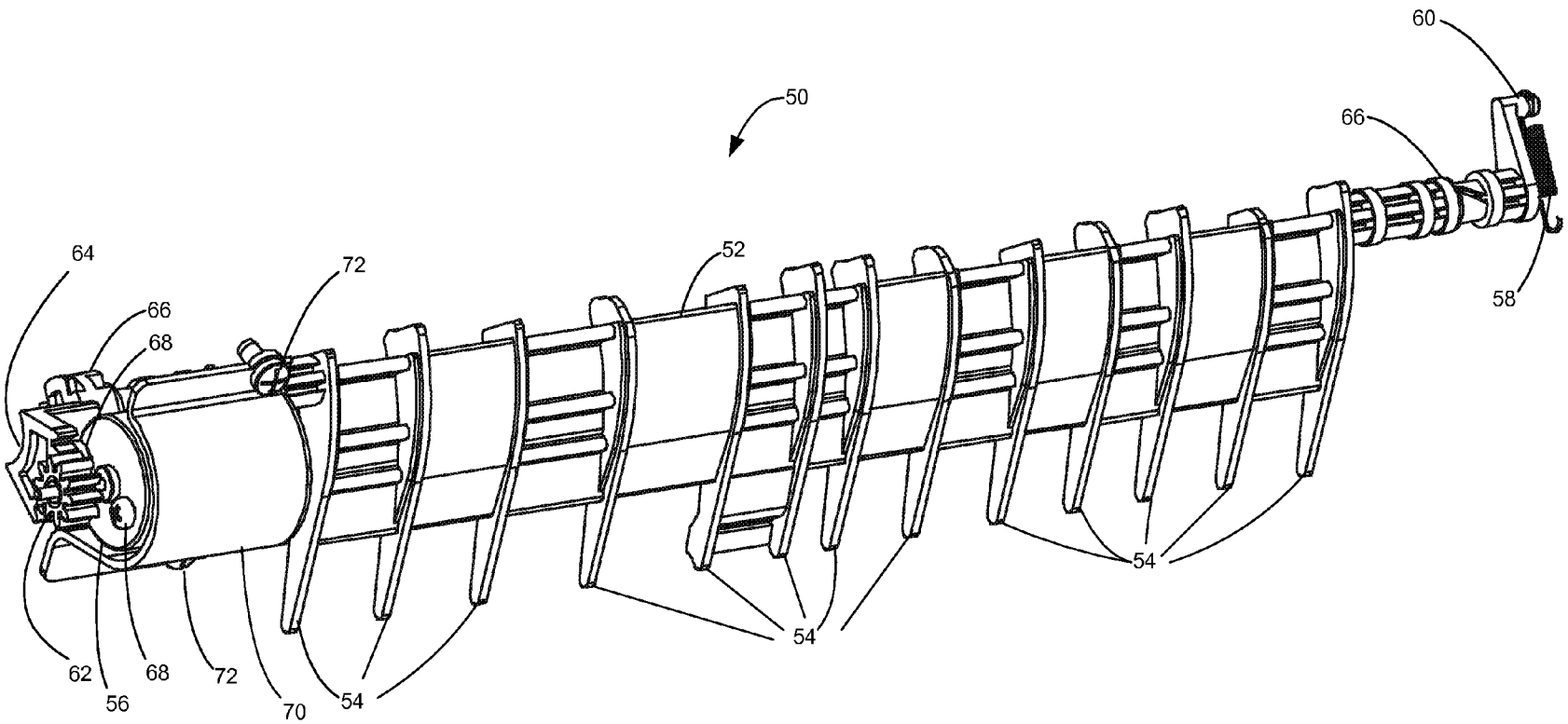
Figure 2 Prior Art
FIG. 2 illustrates the prior art media diverter of FIGS. 1A, 1B.

FIG. 2 illustrates a view of the prior art diverter 50. The diverter 50 has a frame 52 having a plurality of spaced apart, curved triangular ribs 54 over the length of the diverter 50. Frame 52 and ribs 54 are molded as a unitary piece. Adjacent one end of the diverter 50 is mounted a motor 56 and on the other is mounting a biasing spring 58. The biasing spring 58 has one end attached to a lever arm 60 extending from the frame 52 and the other end to a mount within the imaging device 10. A pinion gear 62 is attached to the motor 56 shaft and drives a sector gear 64 attached to frame 52. Bushings 66 are provided on each end of the diverter 50. Mounting screws 68 are used to secure the motor 56 to the imaging apparatus 10. In addition a motor cover 70 is mounted to the motor with mounting screws 72. Motor 56 is used to position the diverter 50 within the media path 12 as previously described. In addition, wiring not shown is routed to the diverter 50 to provide electricity to power the motor 56. Diverter 50 comprises a number of components and to be able to eliminate these and the cost of operating the motor 56 while being able to provide for duplex printing or scanning would be advantageous.

Figure 3:
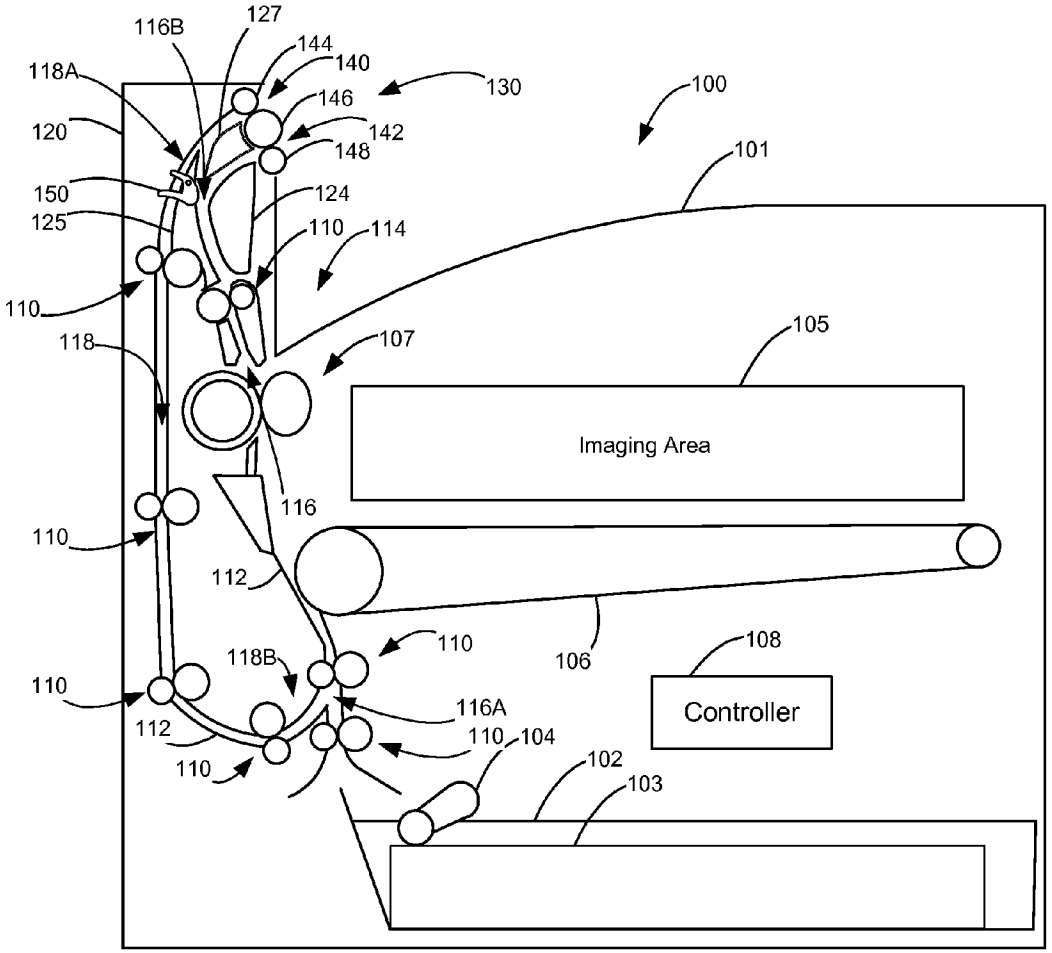
FIG. 3 schematically shows an imaging device using an embodiment of a media driven media diverter and exit path assembly.

FIG. 3 illustrates one embodiment of imaging device 100, which as illustrated is an electrophotographic printer. Imaging device 100 has a housing 101 containing a media input tray 102 having a media stack 103 to be transported through imaging device 100. A feed mechanism 104 is used to feed a media sheet from the media stack 103 into a media path 112 where it is transported by a plurality of feed roll pairs 110 positioned about the media path 112. In general, one roll of each feed roll pair 110 is a driven roll while the other is an idler roll, similar to transport rolls 26-1, 26-2. The media path 112 comprises a simplex path 116 and a duplex path 118. An entrance 116A to the simplex path 116 is adjacent to media input tray 102. Imaging area 105 creates and transfers a toner image onto a transfer belt 106 as is known in the art. The toned image is transferred to one side of a media sheet being transported along the simplex path 116. The media sheet is conveyed to a fuser 107 where the toned image is bonded to the media sheet and then to an exit path assembly 130 at which it either exits into an output area 114 or is redirected into the duplex path 118 for having another image transferred to the back side of the media sheet. Guide members 120, 124, 125, 127 form portions of the simplex path 116 and duplex path 118 and direct the media sheet into the proper media path. Guide member 125 is positioned between the simplex path 116 and duplex path 118. A small portion of guide member 125 adjacent its tip, that is several millimeters in length, forms together with media guide 127 a short extension of the simplex path 116 that leads to the first exit nip 140. The exit 116B of simplex path 116 and the entrance 118A to duplex path 118 are on opposite sides of guide member 125. A media actuated media diverter 150 is installed in guide member 125 and movable between the duplex path 118 and the simplex path 116. Media actuated media diverter 150 controls the transport of the media sheets during duplex printing operations. A controller 108 is used to direct the operation of feed mechanism 104, imaging area 105, transfer belt 106, fuser 107, feed roll pairs 110, and exit path assembly 130 and a user control panel not shown. Controller 108 may include a microcontroller with associated memory. In one embodiment, controller 108 includes a processor, random access memory, read only memory, and an input/output interface.

With reference to FIGS. 4, 6A, 6B, 10A, 10B a media actuated media diverter of the present disclosure is illustrated. Similar elements will where possible have similar numbering. In these Figures only a portion of the imaging device 100 adjacent an exit path assembly 130 and guide members 120, 124, 125, 127 is illustrated. The output area, generally indicated as 114, is provided next to the exit path assembly 130 in the top of housing 101 and receives media sheets exiting the exit path assembly 130. Guide members 120, 124, 125, 127 form a portion of media path 112. The surfaces of guide members 124, 125, 127 form simplex path 116 adjacent the simplex path exit 116B while the surfaces of guide members 120, 125, 127 form duplex path 118 adjacent the duplex path entrance 118A. Guide members 120, 124, 125, 127 extend across the media path 112 in a direction transverse to the media feed direction. The width of the guide members 120, 124, 125, 127 is chosen to be greater than the width of the largest media that the imaging device 100 is designed to handle. Guide member 127 is positioned intermediate guide members 120, 124, 125 and adjacent second roll 146 and its surfaces form a portion of the media path 112 going to a first and second exit nip 140, 142 of exit path assembly 130. Guide members 120, 124, 125, 127 may be provided with a plurality of spaced ribs 129 projecting into media paths 116, 118. Guide member 120 may be formed in a cover of the housing 101 of imaging device 100. Guide members 120, 124, 125 may be rotatable or moveable to allow for access into the media path 112 to clear media sheets that have jammed; however, they are stationary during normal media feeding operations. Guide member 127 may be fixed. Guide member 125 is rotatable in the direction indicated by arrow A in FIG. 4 and is positioned between the simplex path 116 and duplex path 118 and has a first surface 125-1 forming a portion of the duplex path 118 and a second surface 125-2 forming a portion of the simplex path 116.

As previously described, the exit path assembly 130 comprises a first exit nip 140 and a second exit nip 142. First exit nip 140 is formed by a first roll 144 and a second roll 146 and the second exit nip 142 is formed by the second roll 146 and a third roll 148. Rolls 144, 146, 148 are shown as corrugated rolls for illustrative purposes only as is known in the art and the first and second exit nips 140, 142 are corrugated nips. The spacing between adjacent rolls is relatively narrow such that the outer surface of the first roll 144 overlaps with the outer surface of the second roll 146 which overlaps with the outer surface of the third roll 148. The overlap between adjacent rolls forms the corrugated nip. When a media sheet passes through a corrugated nip, a corrugation in the form of an alternating bend is introduced across a length of the media sheet. The corrugation is temporary and occurs only when the media sheet is in the nip. The corrugation aids in preventing the media sheet from collapsing under its own weight as it is cantilevered outward from the first or second exit nip 140, 142. Where one media sheet is extended from the first exit nip 140 during a peek-a-boo duplex operation and another media sheet is exiting from the second exit nip 142 simultaneously, corrugation of the first exit nip 140 helps prevent the duplexing media sheet from folding down into contact with and disrupting the media sheet exiting the second exit nip 142. Corrugation of the second exit nip 142 helps prevent the media sheet exiting the second exit nip 142 from interfering with media sheets in the output area 114 as the media sheet is advanced outward by the second exit nip 142. The rotational direction of the first roll 144 and the third roll 148 are the same while the second roll 146 rotates in the opposite direction. Operation of exit path assembly 130 corresponds to that of exit path assembly 30 except that for simplex imaging and the first sheet in duplex imaging, the simplex imaged media sheet and first sheet of the duplex imaged media exits through first exit nip 140 instead of exit nip 142. A common drive linkage for driving the rotation of the first, second and third rolls 144, 146, 148 may be provided in one embodiment of the exit path assembly 130. The common drive linkage has a one-way clutch coupled to the third roll for limiting the drive of the third roll 148 to one direction. An embodiment of an exit path assembly 130 is described in U.S. patent application Ser. No. 12/900,281, entitled "Exit Path Assembly For An Imaging Device," filed Oct. 7, 2010 and assigned to the assignee of the present disclosure. Another embodiment of an exit path assembly is described in U.S. Pat. No. 7,431,293, entitled "Dual Path Roll For An Image Forming Device," issued Oct. 7, 2008 and assigned to the assignee of the present disclosure.

Provided in guide member 125 is a media actuated media diverter 150 of the present disclosure that is actuated by a media sheet being transported. Media diverter 150 is rotatably mounted in guide member 125 and with no media present is biased to a first position in which a portion extends out into the duplex path 118 for contacting a fed media sheet M and when contacted rotates to a second position at which another portion of the media diverter 150 extends into the simplex path 116 to direct a following media sheet into the second exit nip 142. In one form, media diverter 150 comprises a rod 152 and a plurality of plates 154 as shown, rotatably mounted on the rod 152. The rod 152 and plurality of plates 154 are mounted in guide member 125 as explained herein.

Figure 5:
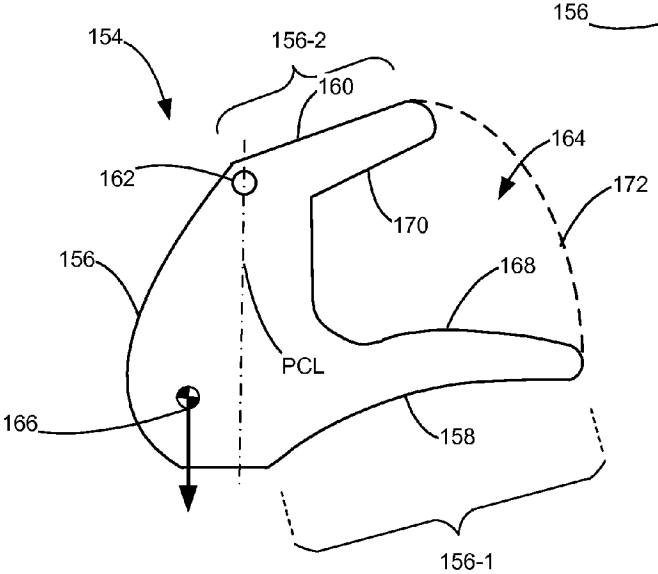
FIG. 5 is an elevational view of an embodiment of a plate used in a media actuated media diverter.

Referring to FIG. 5, each plate 154 has an edge 156 with media guiding surface 158, a rib is illustrated, formed along a first portion 156-1 of the edge 156 and a media contact surface 160 formed along a second portion 156-2 of the edge 156. A pivot hole 162 is provided through each plate 154 near one end of media contact surface 160 for rotatably mounting each plate 154 onto rod 152. Edge 156 as illustrated is a continuous edge with first and second edge portions 156-1, 156-2 positioned generally opposite one another. However this arrangement is a matter of design choice and other orientations for the media guiding surface 158 and media contact surface 160 may be used (see FIG. 7B). Each plate 154 may have a cutout 164 providing each plate 154 with a first finger 168 opposite a second finger 170. First finger 168 has a portion of media guiding surface 158 along its outer edge while second finger 170 has media contact surface 160 along its outer edge. Media guiding surface 158 is shown having a smooth curvilinear shape, a convex curve as shown, which helps guide the leading edge of a media sheet to second nip 142 of exit path assembly 130. Other smooth curvilinear surfaces may be employed for the media guiding surface 158. Further it should be understood each plate 154 in comprising the plurality of plates 154 need not be identical in their features. For example some plates may have a convex shaped surface while others may be concave and extend further into the simplex path. With such an arrangement a higher force can be applied to a portion of the media sheet beneath the media guiding surface 158.

Figure 4:
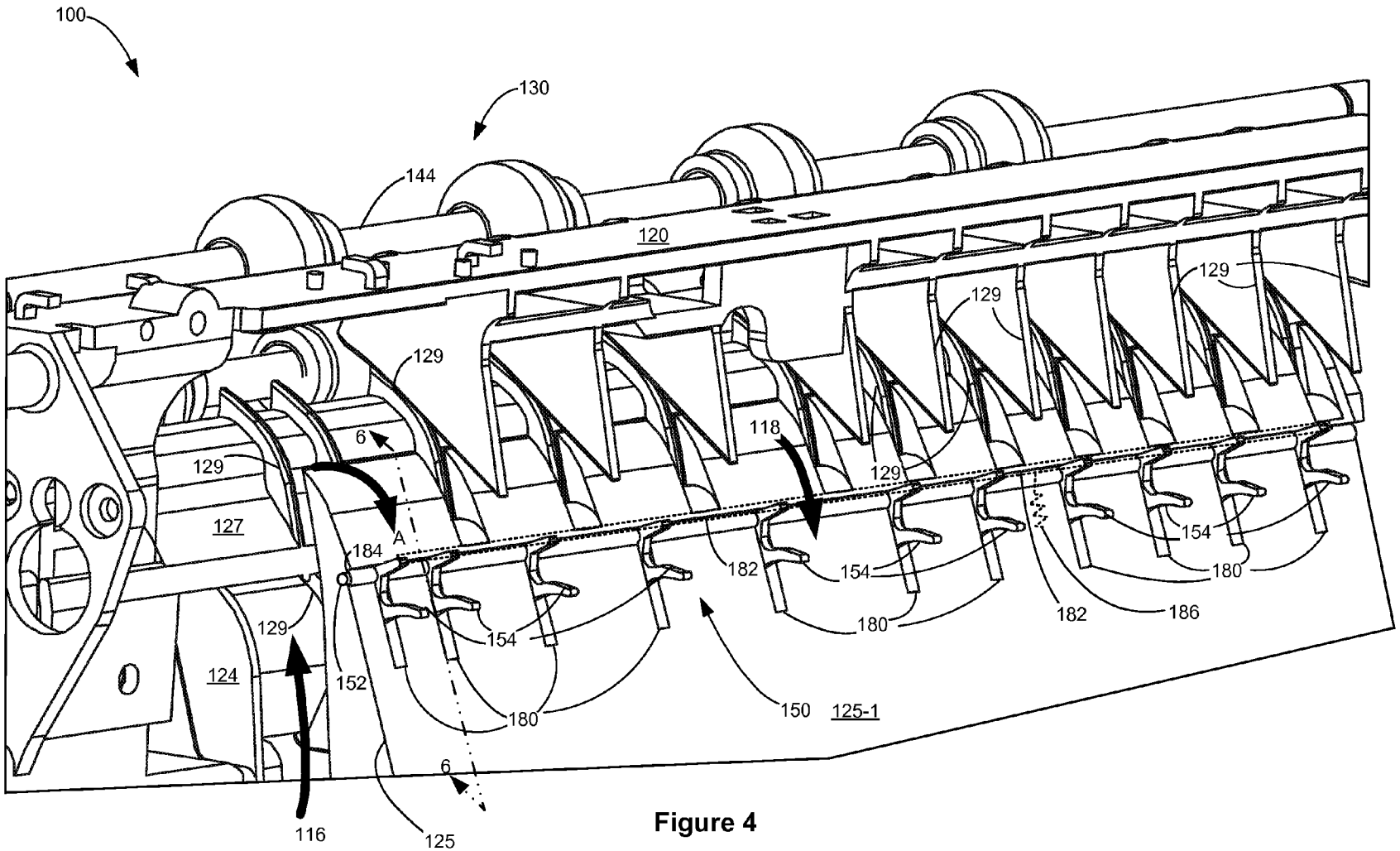
FIG. 4 illustrates a partial perspective elevational view of an embodiment of a media actuated media diverter and exit path assembly.

Guide member 125 includes a first plurality of spaced slots 180 extending across the width of the guide member 125 and extending through guide member 125 adjacent a tapering end thereof adjacent duplex path entrance 118A (see FIG. 4). The width and height of slots 180 are sized to receive plates 154 of media diverter 150 and allow the plates 154 to rotate freely therein. An opening 184 between first and second surfaces 125-1, 125-2 of guide member 125 extends across the width of guide member 125 and intersects each slot 180. The opening 184 is sized to receive rod 152. Rod 152 is fed through opening 184 and through each slot 180 and the pivot hole 162 of each plate 154 in each slot 180. As shown, plates 154 freely pivot about rod 152 and in slots 180. Rod 152 remains in place due to friction between the walls of opening 184 and itself. Other means may also be used to secure rod 152 in place in guide member 125.

Figure 6B:
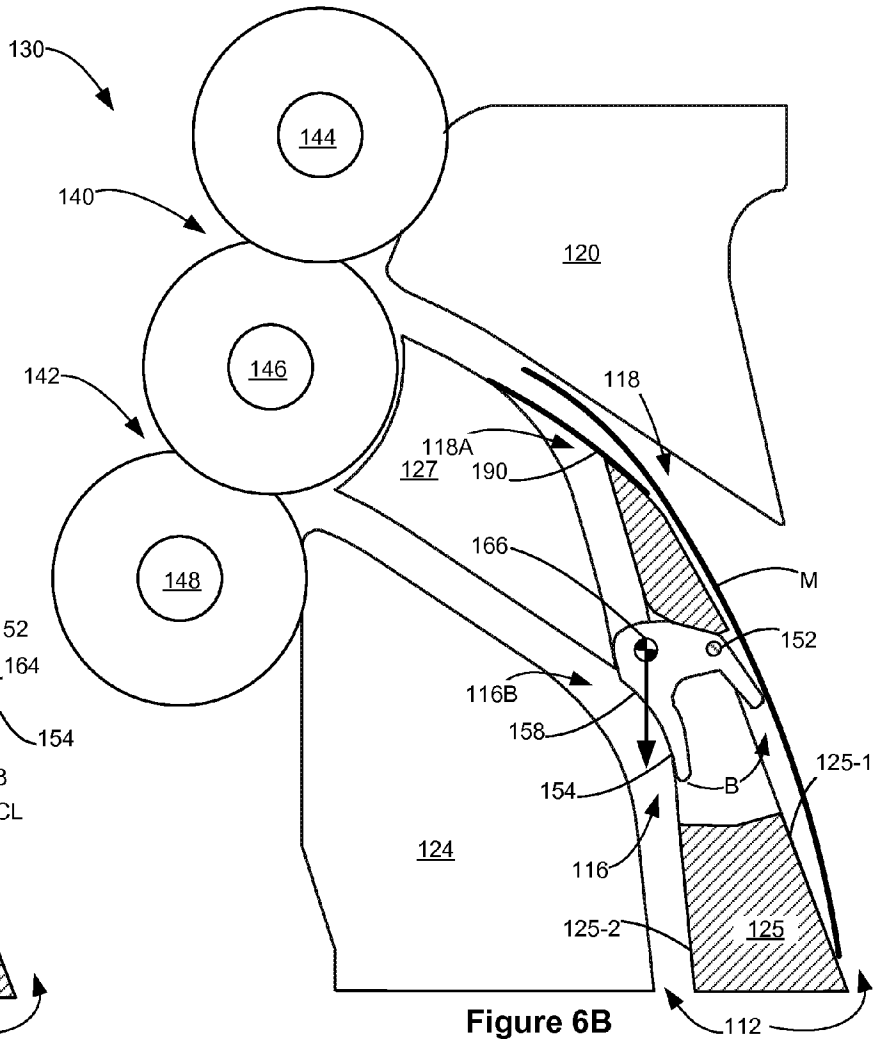
FIGS. 6A, 6B illustrate the operation of a media actuated media diverter according to one embodiment with a partial sectional view of a guide member housing the media diverter taken along line 6-6 in FIG. 4.
Figure 6A:
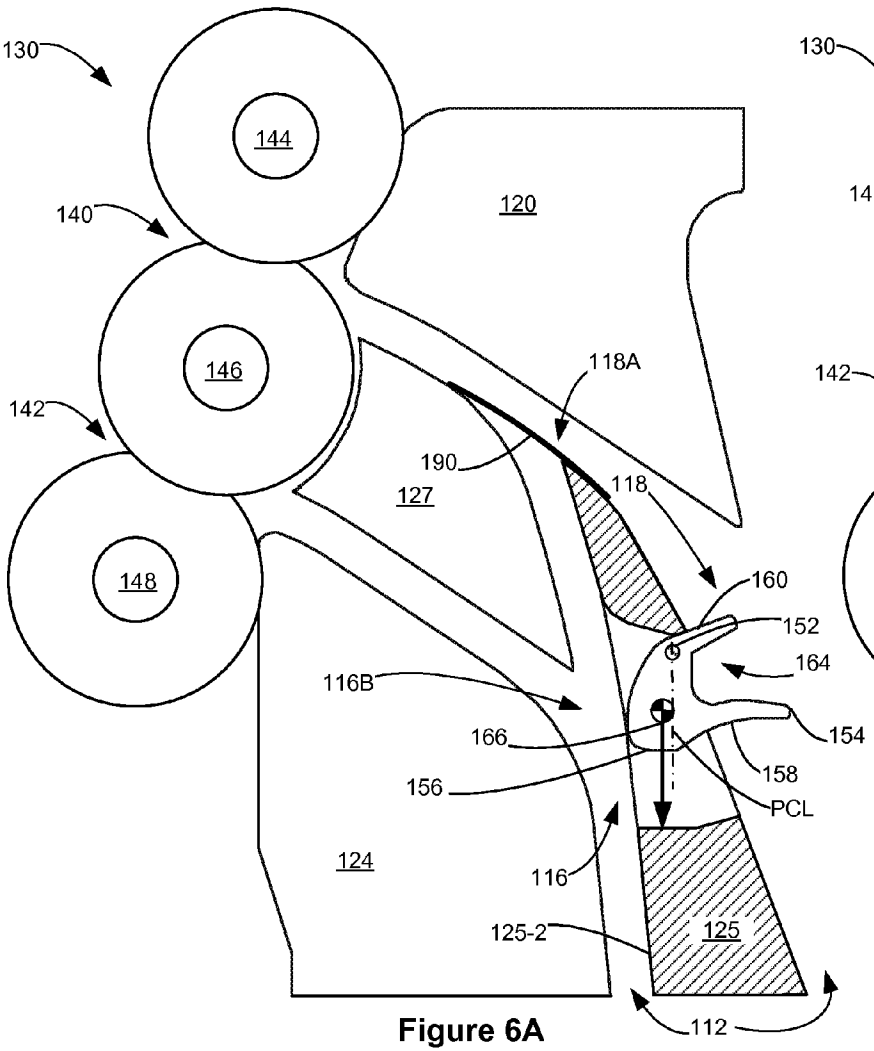

FIG. 6A illustrates plate 154 in its initial or rest position where media contact surface 160 extends into duplex path 118 while rib 158 is rotated out of simplex path 116 and in one embodiment abuts the top of its corresponding slot 180 that acts as a stop. It should be realized that each plate 154 in the plurality of plates in media diverter 150 is similarly positioned. A center of gravity 166 for plate 154 is, as illustrated below, slightly offset from (as illustrated left of) a vertical center line PCL through pivot hole 162. This location for the center of gravity 166 ensures that each plate 154 is biased in this first position when a media sheet is not present, which in one embodiment would be against a stop if one is provided. In FIG. 6B, a media sheet M is shown having contacted media contact surface 160 and passing over it as it is fed from first nip 140 into duplex path 118. This rotates plate 154 clockwise, as viewed, on rod 152 about pivot hole 162 and raises the center of gravity 166 of plate 154 to approximately the level of pivot hole 162. In this raised position media guiding surface 158 blocks the portion of simplex path 116 leading to first nip 140. Accordingly, a following media sheet would be directed to second nip 142 by the plate 154. When in the raised position, plate 154 is unable to rotate back to its initial or first position when a media sheet is present, either in the duplex path 118 about its entrance 118A as shown or when one is present in the exit 116B of the simplex path 116 and the trailing edge of the exiting media sheet has not yet passed the media guiding surface 158 while exiting into output area 114 from second nip 142. Friction of the leading edge of the exiting media sheet being directed against media guiding surface 158 serves to move and hold plate 154 in second position (rotated clockwise as shown) in what is termed a "self-assisting" design. With both the simplex and duplex paths 116, 118 empty of media sheets, the moment arm created by the raised the center of gravity 166 about the pivot hole 162 causes the plate 154 to rotate back to its initial position where the media contact surface 160 again projects into duplex path 118 for engagement with the next media sheet being fed from first nip 140. Cutout 164 is one means used to shift the center of gravity 166 of each plate 154 close to edge 156. Other means include placing a weight in plate adjacent edge 156, increasing the thickness of plate 154 in a region adjacent the edge 156 along portion 156-1 or decreasing the thickness of second finger 170. Plate 154 may in another embodiment be made without a cutout as indicated by dashed line 172 (see FIG. 5).

The number of plates 154 provided along the width of guide member 125 is a matter of design choice. At least one plate 154 should be contacted by the edge of the media sheet being fed. However, to minimize damage to the edge of the media sheet caused by the force of the media sheet striking either media guiding surface 158 or media contacting surface 160, at least two plates should be provided for narrower media, such as an envelope, and more than 2 plates for conventional media such as A4. A higher number of plates also reduces the amount of edge buckling that occurs in the media where it strikes the media guide surface 158 or the media contacting surface 160 of each plate 154 reducing the potential for media sheet jams. For example, as illustrated in FIG. 4, for A4 or 8½×11 media eleven plates 154 may be provided across the width of guide 125. However the total number of plates used has to be balanced against the cumulative inertial load in the plates that the media has to overcome when rotating the plates. Having too large of an inertial load may lead to media damage or a media jam. Typically, the number of plates used would be empirically determined based on operating conditions such as media feeding speeds and media stiffness. The spacing between the plates 154 may be uniform, vary between adjacent plates or use a combination of uniform and varied spacing as illustrated in FIG. 4. In FIG. 4 the media path is a reference edge design with the reference edge or surface for aligning the media sheet as it moves along media path 112 being at the right side of imaging device 100 as viewed in FIG. 4. Accordingly, for the two illustrated plates 154 at the left side of guide member 125 one may be positioned near but not beyond the non-referenced edge of A4 media and the other near but not beyond the non-referenced edge of 8½×11 media, respectively. Similarly, the fourth plate 154 from the right side of guide member 125 may be adjacent but not beyond the non-referenced edge of a standard envelope while the sixth plate 154 from the right side of guide member 125 may be adjacent but not beyond the non-referenced edge of A6 media. The non-referenced edge being the media edge opposite the referenced edge. Other plates 154 may be provided and similarly positioned with respect to other media widths. A similar arrangement of having plates adjacent both but not beyond the outer edges of the media sheet may be used where a center referenced media path is present.

Also shown in FIGS. 6A, 6B is a check valve 190 positioned across the media path portion between guide members 127 and 125. Check valve 190 is pushed out of the way by a media sheet being fed in the simplex path 116 to the first exit nip 140. When the media sheet is being fed from the first exit nip 140 into the duplex path 118, the media acts like a cantilevered beam and when fed from the first exit nip 140 leans against guide member 120 that forms the upper side of the duplex media path 118. Check valve 190 helps ensure that the media sheet cannot be fed back into the simplex path 116 should the media sheet droop or buckle downwardly. In such case, the media sheet would slide over the upper surface of check valve 190 into the duplex path 118. Check valve 190 may be made from a polyester film having a thickness of in the range of 0.06 mm to about 0.09 mm, such as that sold under the trade name MYLAR®, that is affixed to a first surface 125-1 of guide member 125 along one edge of the sheet. Check valve 190 may extend across the entire width of guide member 125 or only a portion thereof. Alternatively, check valve 190 may also be affixed to a second surface 125-2 of guide member 125.

Figure 7A:
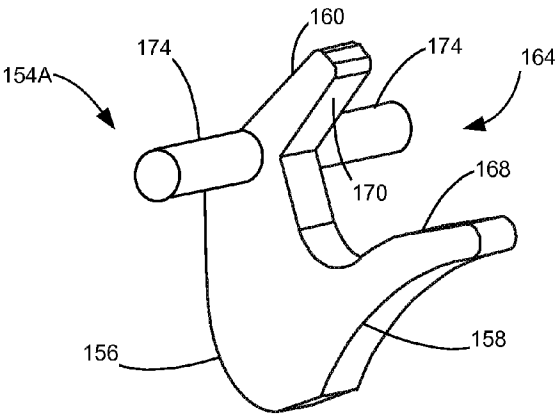
FIG. 7A, 7B illustrate embodiments of a plate for the media actuated media diverter where
Figure 7B:
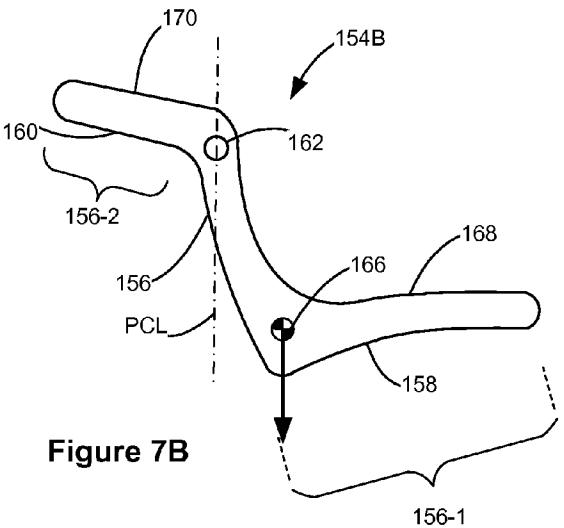
Figure 9:
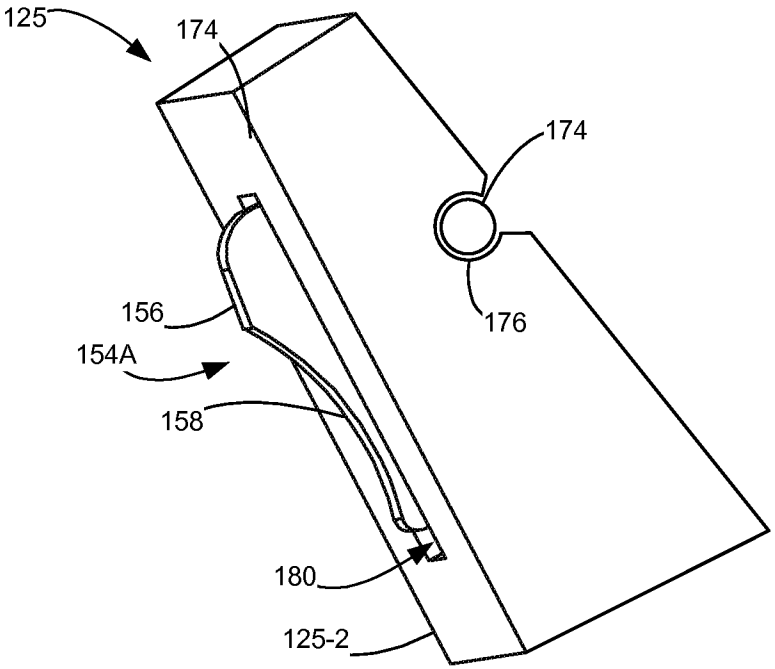
FIGS. 8, 9 illustrate an alternate mounting structure and biasing arrangement for the plate of the media actuated media diverter illustrated in FIG. 7A.
Figure 8:
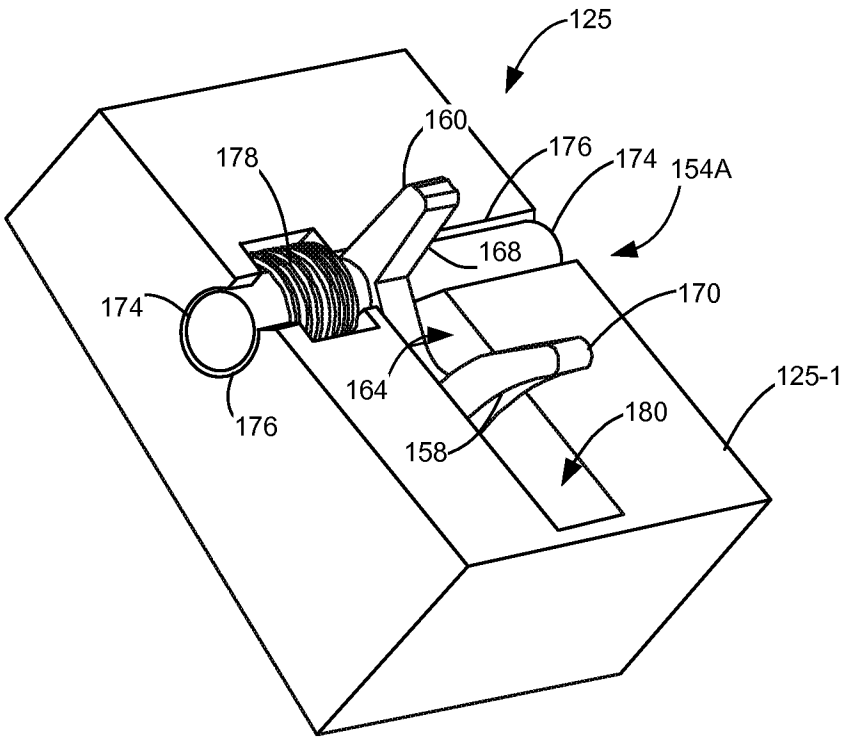

FIGS. 7A, 7B, 8 and 9 illustrate other embodiments of the plates 154 and another embodiment of biasing the plates to the initial position. In FIG. 7A plate 154A is shown having the features previously described except that pivot hole 162 has been replaced by a pair of trunnions 174 mounted on the front and rear surfaces of plate 154 as viewed in FIG. 7A. Media contact surface 160 and media guiding surface 158 are present along edge 156 of plate 154A. Cutout 164 and first and second fingers 168, 170 are also provided. FIGS. 8 and 9 illustrate the mounting of plate 154A. A pair of trunnion mounts 176 are formed in first surface 125-1 of guide member 125 on each side of slot 180 near its upper end. Trunnion mounts 176 are sized to accommodate trunnions 174 on plate 154A. Trunnions 174 are snap-fit into place in trunnion mounts 176. Plate 154A is free to rotate in slot 180 and is biased in a first position where media contact surface 160 extends into duplex path 118 due to the off-center location of its center of gravity as previously described. In FIG. 8 plate 154A is shown in its first biased position extending beyond first surface 125-1 of guide member 125 while in FIG. 9 plate 154A shown in its second position having rib or media guiding surface 158 extending beyond second surface 125-2 of guide member 125. Trunnion mounts in one embodiment may form a continuous channel extending across a portion of the width of guide member 125. Also illustrated in FIG. 8 is another embodiment of a biasing means for plate 154A. A torsion spring 178 is mounted on one of the trunnions 174 and the corresponding trunnion mount has been enlarged to accommodate spring 178. Spring 178 is used to bias plate 154A in its first position. It will be realized that other forms of biasing members including, but not limited to, compression springs, tension springs, leaf springs, may be used. Further, as shown in FIG. 4 another biasing embodiment is illustrated. There at least two of the plates 154 may also be coupled together such as by a rod or support 182, shown in dashed lines, connecting the distal ends of first fingers 168 with one or more biasing members 184, shown in dashed lines, acting between the support or rod 182 and guide member 125.

Another embodiment of the plate is shown in FIG. 7B. There plate 154B is shown having second finger 170 oriented away from first finger 168. Plate 154B may be described has being Z-shaped as distinguished from plate 154, 154A that is C- or U-shaped. The other features of plate 154B are substantially identical to plate 154 including that plate 154B has a center of gravity 166 that is offset from the vertical centerline PCL of pivot hole 162.

Figure 10B:
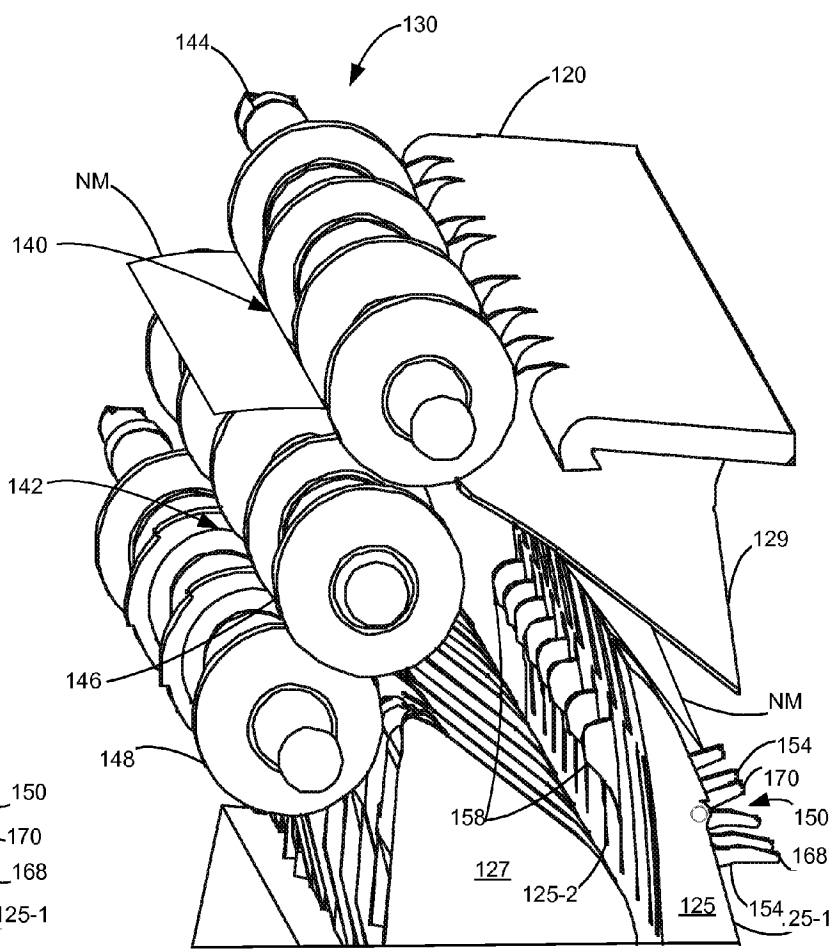
FIGS. 10A, 10B show a partial perspective elevation view of an exit path assembly and media actuated media diverter and the feeding of a narrow media into a duplex media path and actuating the media diverter according to one embodiment.
Figure 10A:
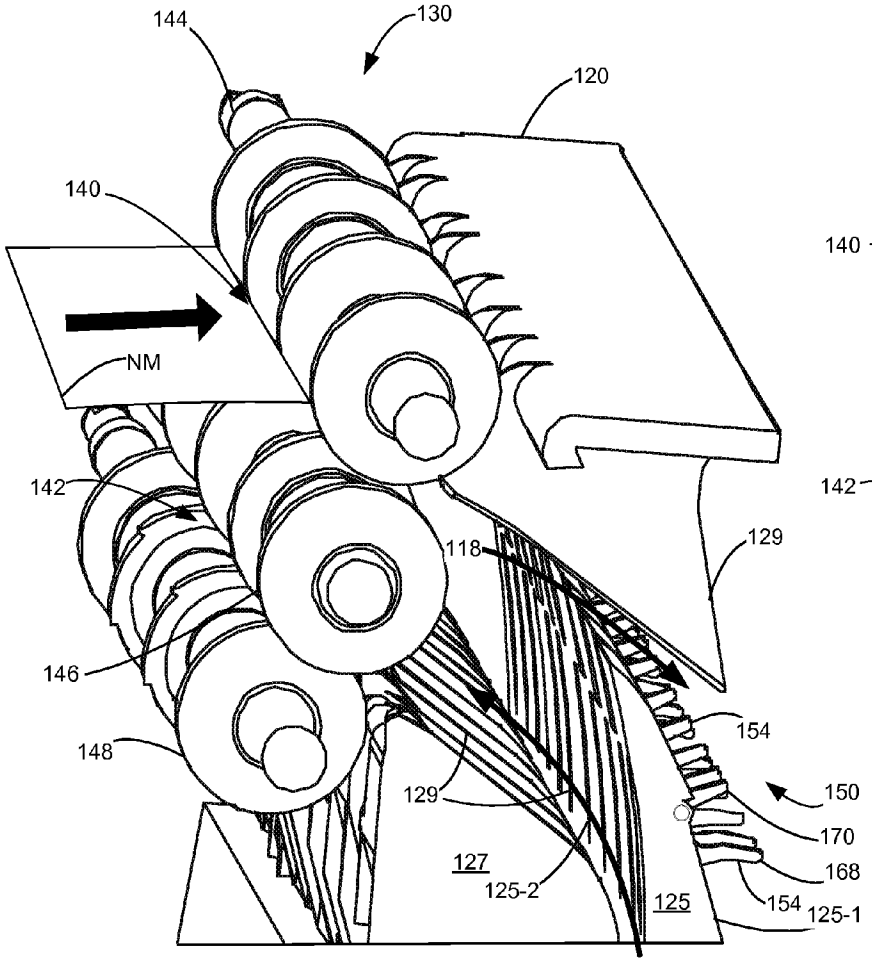

FIGS. 10A, 10B illustrate the operation of media diverter 150 with a narrow media sheet NM. In FIG. 10A, media actuated media diverter 150 is shown with each of plates 154 being in their respective first positions as narrow media sheet NM is fed from first nip 140 into duplex path 118. In FIG. 10B, narrow media sheet NM has been fed into duplex path 118 and eight of the plates 154 have moved to their second position where the media guiding surfaces 158 can be seen projecting into simplex path 116 from the second surface 125-2 of guide member 125 while the remaining three plates have not moved because they have not be contacted by the narrow media NM as it is transported along the duplex path 118. It will be realized that the actual height of the media paths 116, 118 have been enlarged to enable illustration of the positions of the plates 154.

Figure 11:
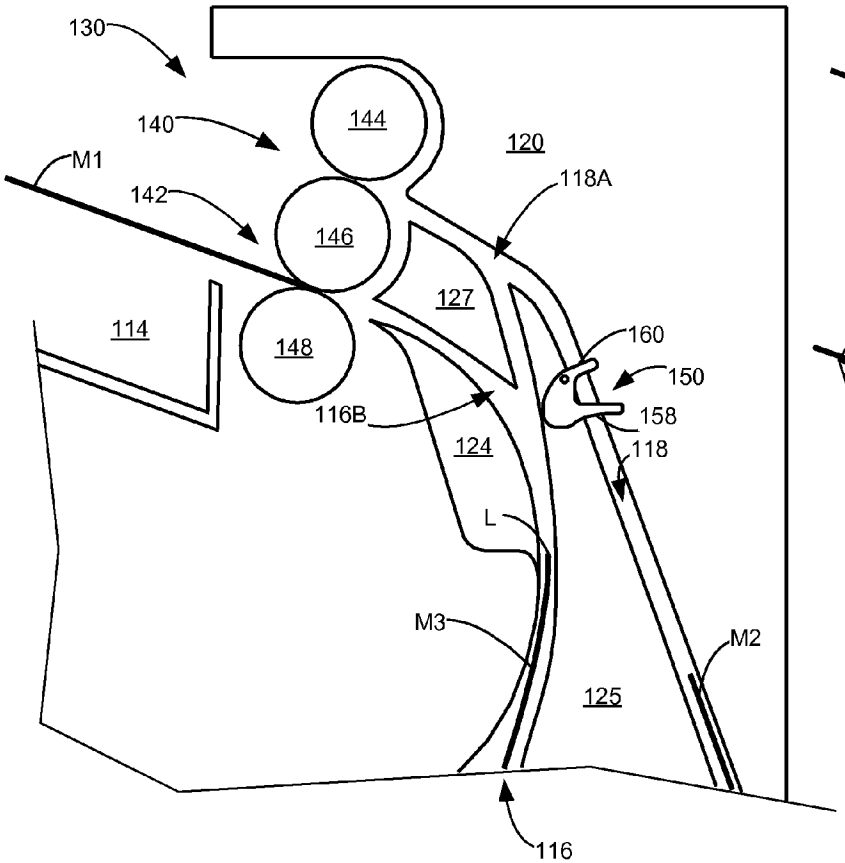

With reference to FIGS. 11-15, the sequencing of a duplex imaging operation is illustrated. In FIG. 11, media sheet M1 is exiting at the second exit nip 142 by being driven by third roller 148 of exit path assembly 130 toward output area 114. Media sheet M2 is shown downstream of diverter 150 in duplex path 118 after having been driven by first roll 144 out of exit nip 140 and into duplex path 118 and previously passing imaging area 105. Meanwhile the leading edge L of media sheet M3 after passing through imaging area 105 is approaching the exit 116B of simplex path 116.

Figure 12:
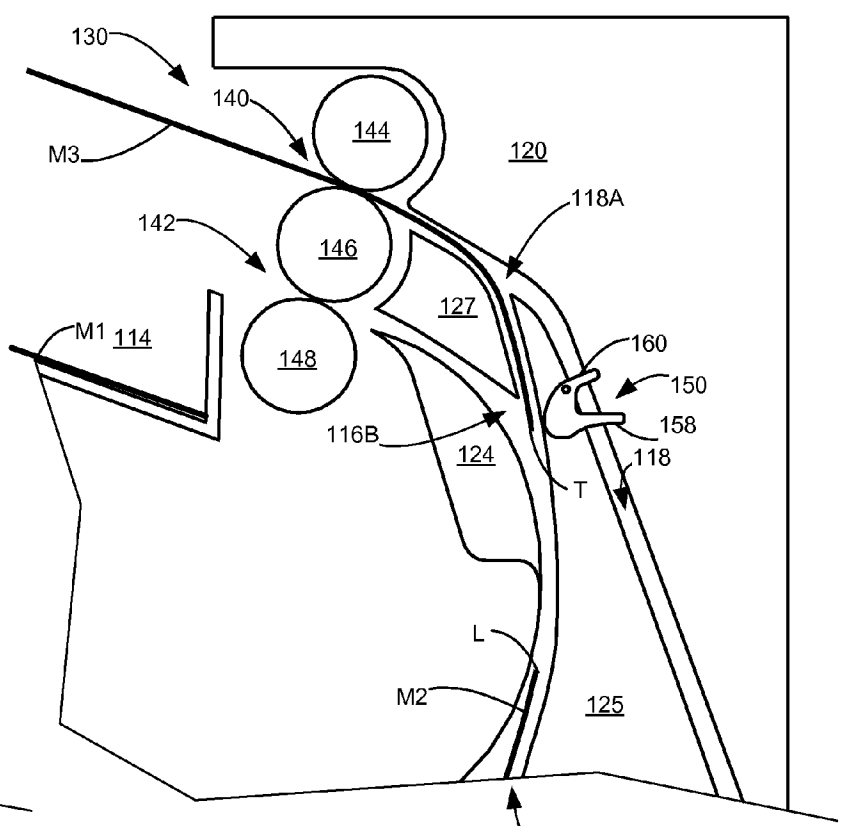
FIGS. 11-15 show the operation of the media actuated media diverter of FIG. 4 during a duplexing operation according to one embodiment.

In FIG. 12, the trailing edge T of media sheet M3 has moved up to media diverter 150 which is in its first or initial position, Media sheet M3 is being driven by first roll 144 out of first exit nip 140. Meanwhile the leading edge L of media sheet M2 after passing through imaging area 105 a second time is approaching the exit 116B of simplex path 116.

Figure 13:
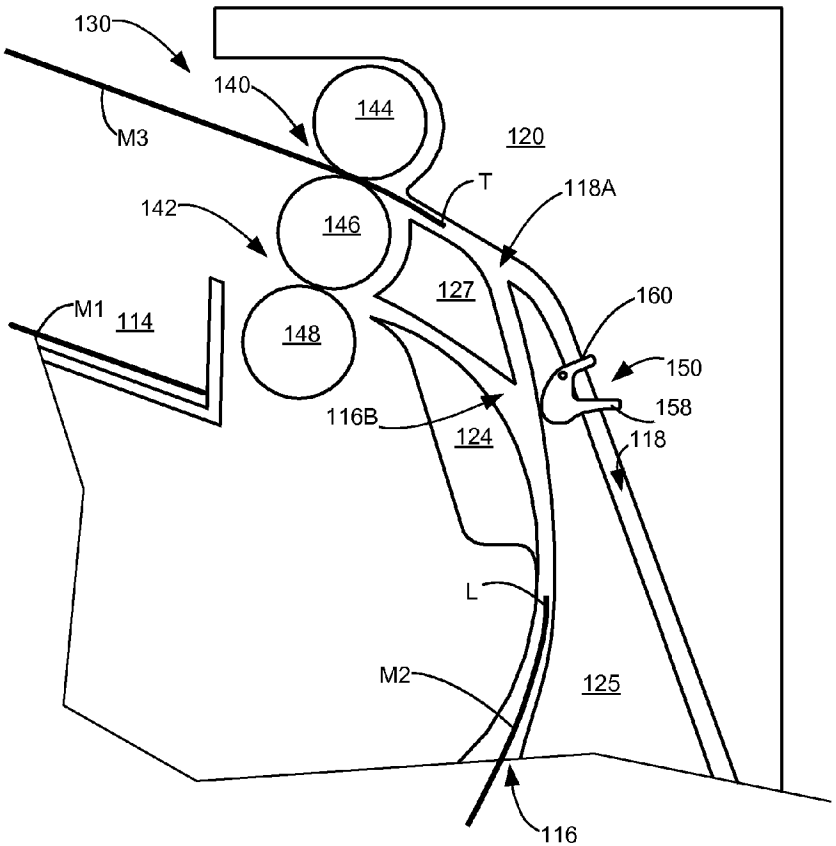

In FIG. 13 media sheet M3 has been exited out first exit nip 140 so that its trailing edge T has moved to a position so that it can enter entrance 118A to duplex path 118. Leading edge L of media sheet M2 is still approaching media diverter 150 and the exit 116B of simplex path 116.

Figure 14:
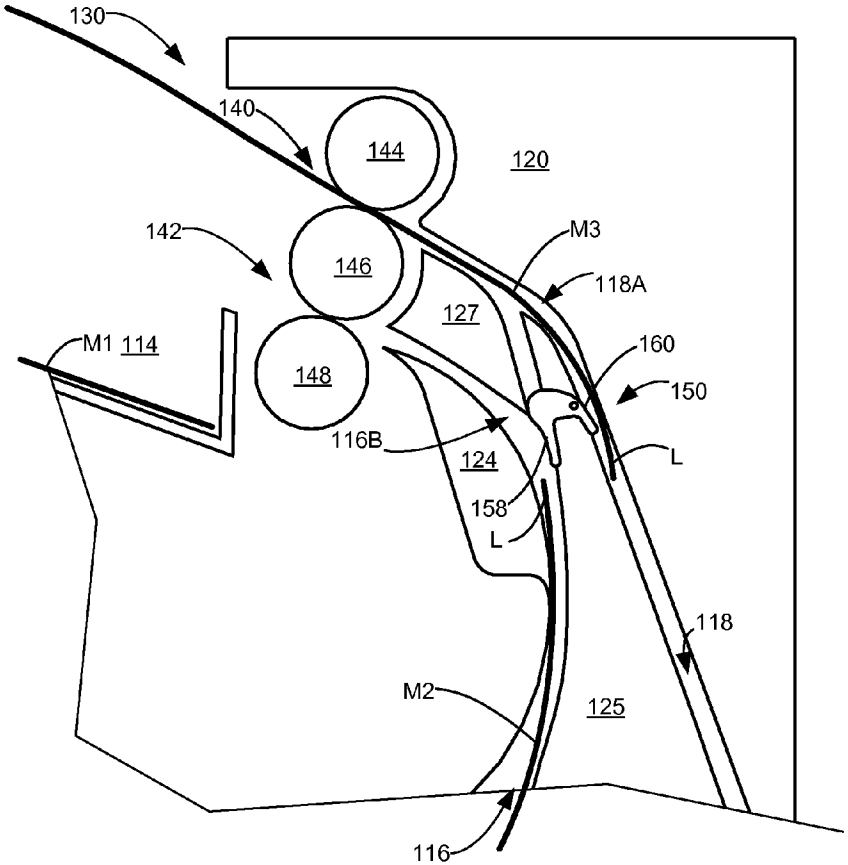

In FIG. 14, first roll 144 has reversed and trailing edge T of media sheet M3 now becomes leading edge L of media sheet M3 and is driven into duplex path 118 and contacts one or more media contact surfaces 160 of plates 154 of media diverter 150. As media sheet M3 continues to be driven into duplex path 118 by first roll 140, media diverter 150 is actuated by media sheet M3 and rotates into its second position in the simplex path 116 so that media guide surface 158 blocks the extension portion of the simplex path 116 leading to first roll 140 and the entrance 118A of duplex path 118. The actuation of the media diverter 150 by media sheet M3 occurs prior to the arrival of the leading edge L of media sheet M2 at the media diverter 150.

Figure 15:
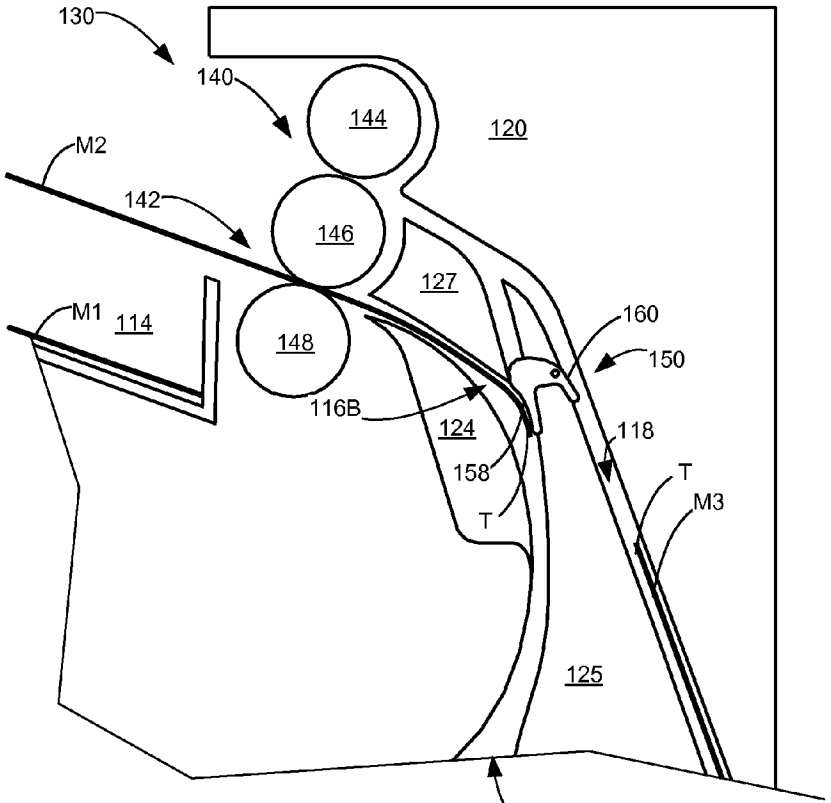

In FIG. 15 the trailing edge T of media sheet M3 has moved downstream of media diverter 150 in duplex path 118. However media diverter 150 has not returned to it initial position. This is because the trailing edge T of media sheet M2 has not cleared media guide surface or rib 158 as it is being fed out of second exit nip 142 by third roller 148 into exit area 114. Once media sheet M2 has exited second exit nip 142, first exit nip 140 is available to drive the next media sheet into the duplex path 118 repeating the process.

FIGS. 16-20 illustrate a further embodiment of the invention along with its operation in the media path 112. Media guides 120, 124, 127 are positioned as previously described near output area 114. Media guide 125 is modified slightly and is designated as media guide 225 in the FIGS. 16-20. Exit assembly 130 and first second and third exit rolls 144, 146, 148 operate as previously described. A two plate media actuated media diverter 200 is illustrated in FIGS. 16-20.

Media actuated media diverter 200 is comprised of plurality of first plates 210 and a corresponding plurality of second plates 220 mounted within a corresponding plurality of slots 280 in guide member 225. A first plate 210 and second plate 220 are pivotally mounted in each slot 280 on respective first and second rods 230, 232 provided in guide member 225.

Each first plate 210 generally has a shape of a right triangle. Each first plate 210 has an edge 212 having along a first portion thereof a media contact surface 214 and along a second portion thereof a first abutment surface 216. A pivot hole 218 is provided through each first plate 210 near one end of media contact surface 214 for rotatably mounting each first plate 210 onto first rod 230. Edge 212 as illustrated is a continuous edge with media contact surface 214 and a first abutment surface 216 positioned generally opposite one another. However, this arrangement is a matter of design choice and other orientations for the media contact surface 214 and abutment surface 216 may be used.

Figure 21B:
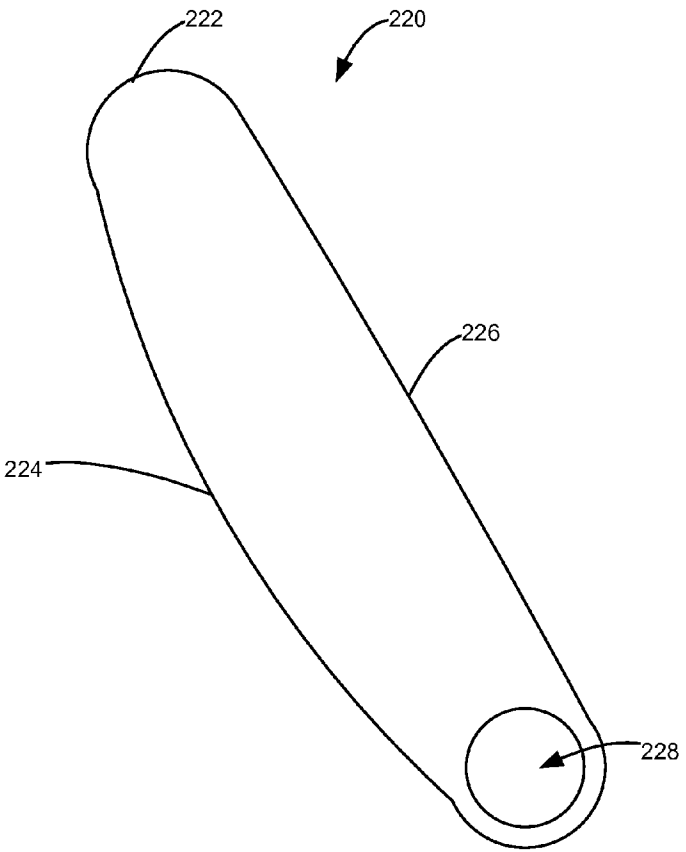
FIGS. 21A-21B illustrate enlarged second plates having various curvilinear shapes for a media guiding surface for use in the media actuated media diverter of FIG. 16.
Figure 21A:
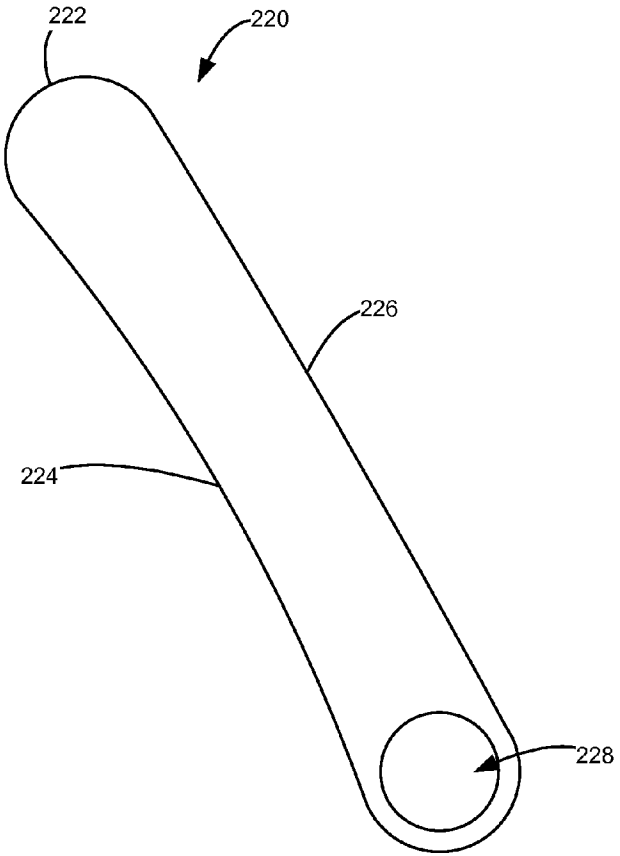

Each second plate 220 is generally rectangular having pivot hole 228 located at a lower end as illustrated. Each second plate 220 has an edge 222 having along a first portion thereof a media guiding surface 224 and along a second portion thereof an abutment surface 226. Edge 222 as illustrated is a continuous edge with media guiding surface 224 and a second abutment surface 226 positioned generally opposite one another. However this arrangement is a matter of design choice and other orientations for the media guiding surface 224 and second abutment surface 226 may be used. Media guiding surface 224 is shown having a smooth curvilinear shape, a concave curve as shown, which helps guide the leading edge of a media sheet to second nip 142 of exit path assembly 130. Other smooth curvilinear surfaces, such as a concave curve, may be employed for the media guiding surface 224. FIGS. 21A-21B provide an enlarged view of second plate 220 having edge 222, media guiding surface 224, abutment surface 226 and pivot hole 228. In FIG. 21A, second plate 220 is shown with media guiding surface 224 as being a concave curve. In FIG. 21B, second plate 200 is shown with media guiding surface 224 as a convex curve. A plurality of second plates 200 may be provided with the media guiding surface on at least one plate in the plurality of second plates having a convex shape and at least one other plate in the plurality of second plates having a concave shape.

Figure 16:
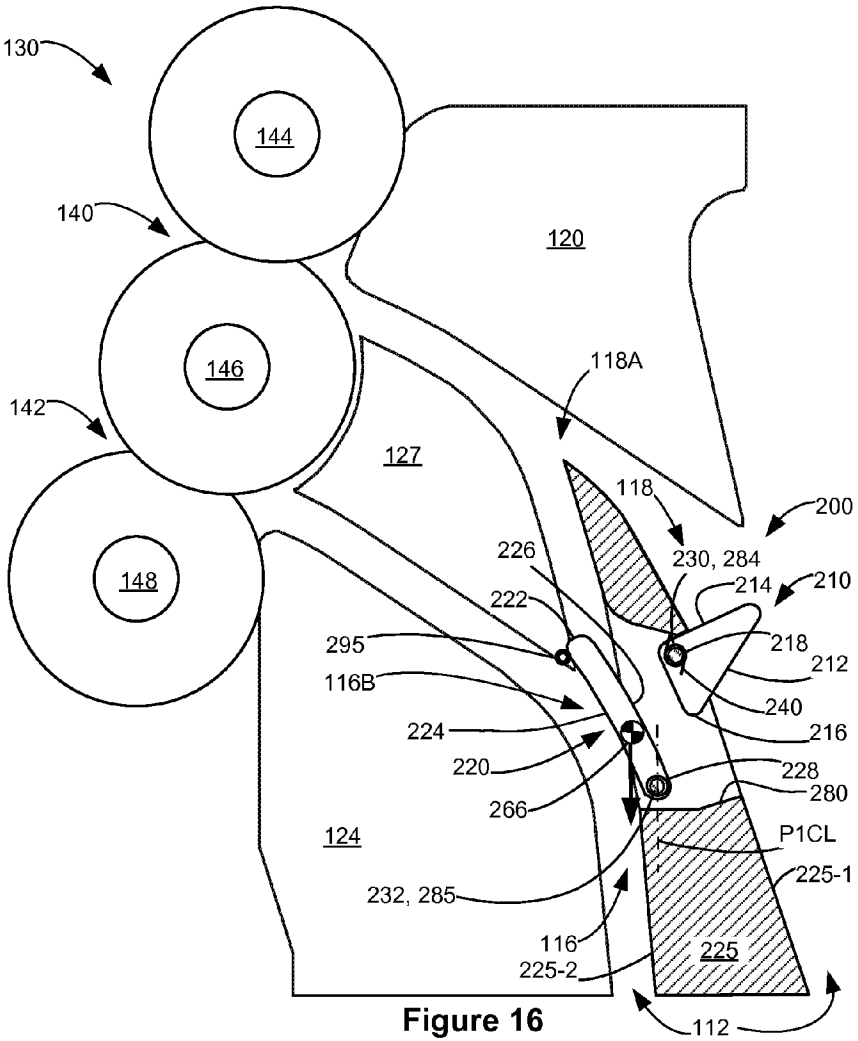
FIG. 16 illustrates an embodiment of a media actuated media diverter utilizing two plates with a partial sectional view of a guide member housing the media actuated media diverter.

FIG. 16 illustrates first plate 210 in its initial or rest position where media contact surface 214 extends into duplex path 118 and in one embodiment abuts the top of its corresponding slot 280 that acts as a stop. It should be realized that each first plate 210 in the plurality of plates in media diverter 200 is similarly positioned. Each first plate 210 is biased in its first position by a biasing member, such as torsion spring 240, with media contact surface 214 extending into duplex path 118 when a media sheet is not present. Torsion spring 240 may be mounted on first rod 230, in a fashion similar to the mounting of spring 178 shown in FIG. 8. Torsion spring 240 may also be located in slot 280. Second plate 220 is also shown in its first or initial position with its distal (non-pivot) end resting against a stop 295 shown located near the apex of guide member 127. The stop 295 is optional and may also be provided in slot 280 adjacent the second surface 225-2 of guide member 225. A center of gravity 266 for second plate 220 is as illustrated, shown below and slightly offset from (as illustrated left of) a vertical center line P1CL through pivot hole 228. This location for the center of gravity 266 ensures that each second plate 220 is biased in its first position with media guiding surface 224 extending into simplex path 216. With both the simplex and duplex paths 116, 118 empty of media sheets, the spring 240 biases the first plate 210 to rotate (counter-clockwise as illustrated) back to its first position, shown abutting the top of slot 280, where the media contact surface 214 again projects into duplex path 118 for engagement with the next media sheet being fed from first nip 140. A moment arm created by the raised center of gravity 266 about pivot hole 228 when second plate 220 is in its second position causes the second plate 220 to rotate back into its first position when the media sheet has passed by second plate 220 on its way to the first exit nip 140. Other means to shift the center of gravity include placing a weight in plate adjacent edge 212 of first plate 210 or near the distal end of second plate 220, increasing the thickness of second plate 220 in a region adjacent the media guiding surface 224.

Guide member 225 includes a first plurality of spaced slots 280 extending across the width of the guide member 225 and extending through guide member 225 adjacent a tapering end thereof adjacent duplex path entrance 118A. The width and height of slots 280 are sized to receive first plates 210 and second plates 220 of media diverter 200 and allow the first and second plates 210, 220 to rotate freely therein. Two openings 284, 285 between first and second surfaces 225-1, 225-2 of guide member 225 extend across the width of guide member 225 and intersect each slot 280. Opening 284 is positioned above opening 285. Opening 284 is sized to receive first rod 230 while opening 285 is sized to receive second rod 232. Rod 230 is fed through opening 284 and through each slot 280 and the pivot hole 218 of each first plate 210, and spring 240 in each slot 280. Rod 232 is fed through opening 285 and through each slot 280 and the pivot hole 228 of each second plate 220 in each slot 280. First rod 230 and second rod 232 remain in place due to friction between the walls of openings 284, 285, respectively and their respective selves. Other means may also be used to secure first rod 230 and second rod 232 in place in guide member 225.

Figure 18:
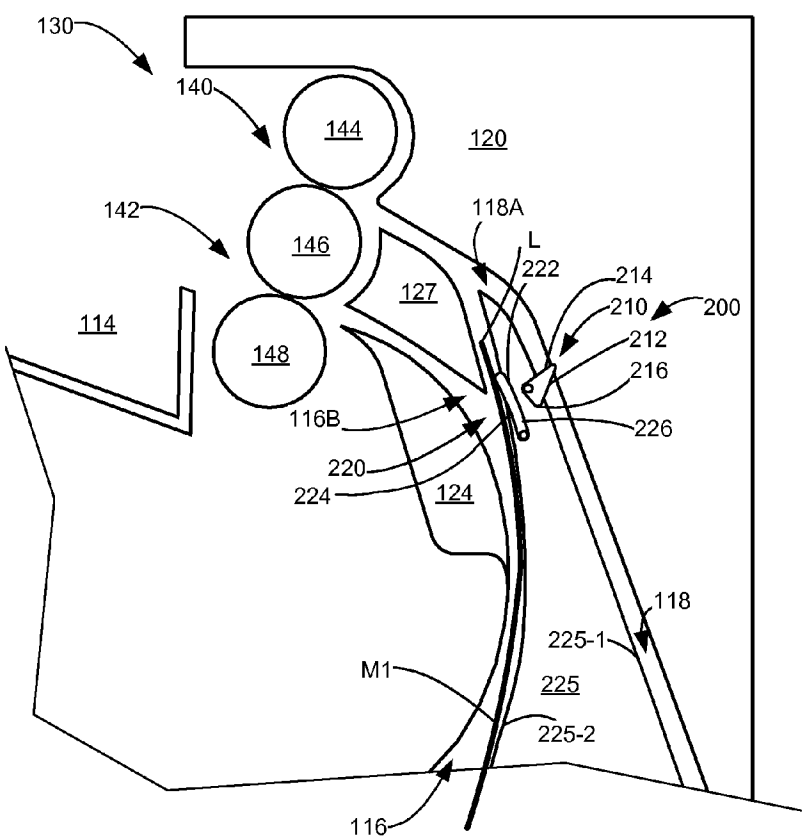
FIGS. 17-20 show the operation of the media actuated media diverter of FIG. 16 during the start of a duplexing operation.
Figure 17:
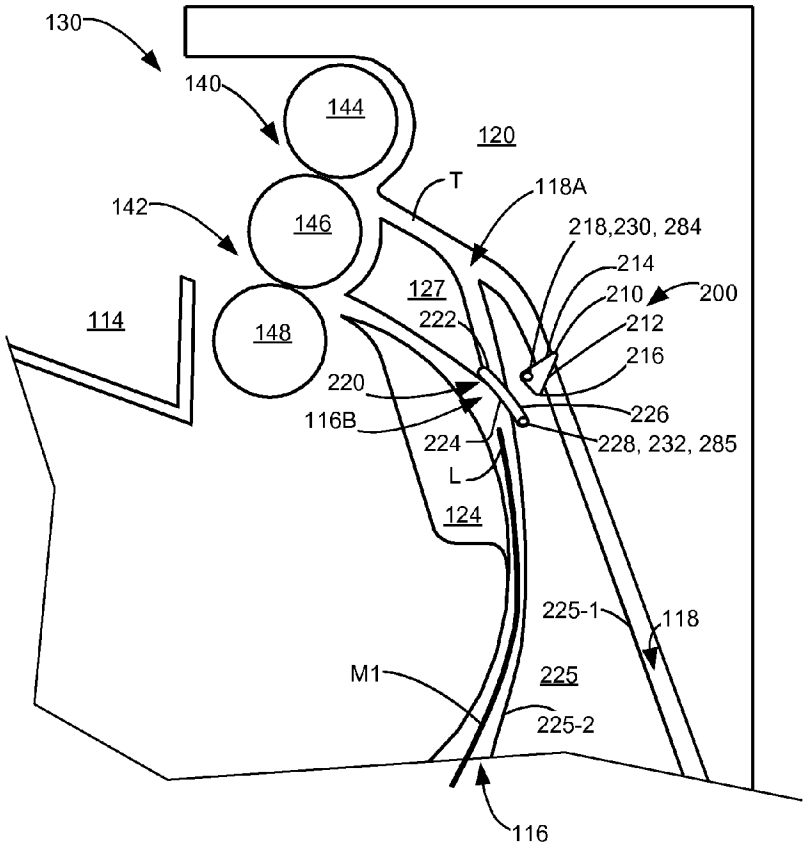
Figure 19:
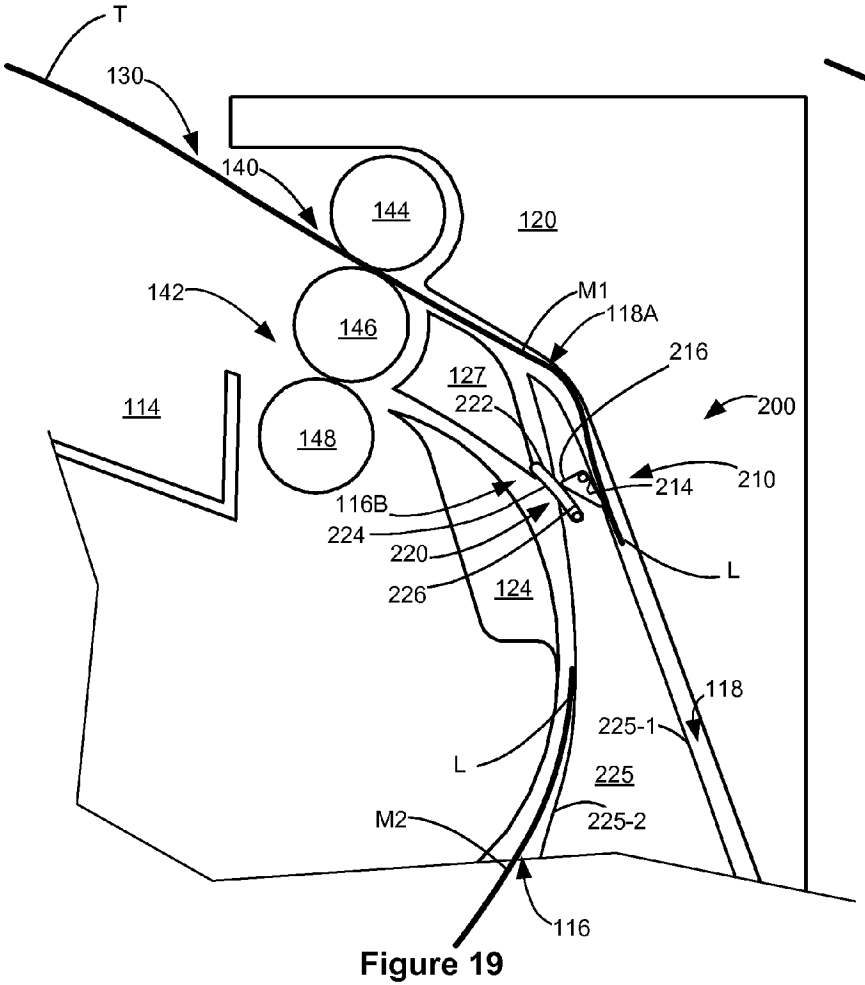

FIGS. 17-20 illustrate the operation of media actuated media diverter 200. In FIG. 17, media sheet M1 after passing through imaging area 105 is approaching the exit 116B of simplex path 116 and media diverter 200 where both first plate 210 and second plate 220 are biased in their respective first positions. In FIG. 18 the leading edge L of media sheet M1 pushes second plate 220 into a second position that, as illustrated, is upward and back toward guide member 225 and out of the way as it travels toward first exit nip 140. When the trailing edge of media sheet M1 passes second plate 220 it falls back to its first position due to the force of gravity. In FIG. 19 media sheet M1 is shown being fed into duplex path 118 from first exit nip 140. The leading edge L of media sheet M1 has contacted media contact surface 214 on first plate 210 rotating first plate 210 approximately ninety degrees into its second position to block the upward rotation of second plate 220. As shown first plate 210 has rotated down into slot 280 and rotated first abutment surface 216 to either contact second abutment surface 226 of second plate 220 or to be in very close proximity to second abutment surface 226. The leading edge L of the following media sheet M2 is shown approaching media diverter 200.

Figure 20:
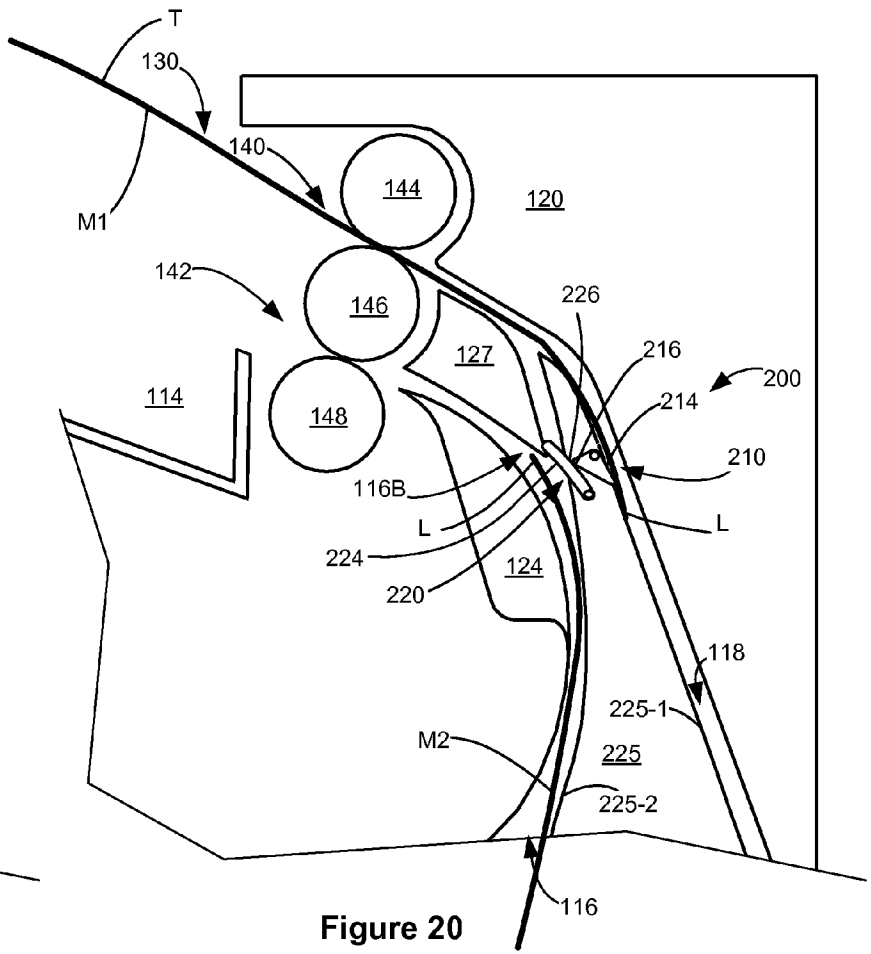

In FIG. 20 the leading edge L of media sheet M2 has been directed by the media guiding surface 224 of second plate 220 toward the second exit nip 142 for subsequent exit into media output area 114. Because first plate 210 is in its second position blocking the rotation of second plate 220 when the leading edge L of the following media sheet M2 encounters media guiding surface 224, second plate 220 does not move. Instead second plate 220 remains in its first position blocking the extension of simplex media path 116 to first exit nip 140. When the trailing edge of media sheet M1 is fed past the first plate 210 of media diverter 200, first plate 210 will rotate back to its first position due to its spring bias unblocking second plate 220 as shown in FIG. 17. At this point second plate 220 may now be moved out of the simplex media path 116 by the next following media sheet.

As previously described one of, or both of the first and second plates 210, 220, may have trunnions with respective trunnion mounts provided in the first and/or second surfaces 225-1, 225-2 of guide member 225. Biasing means, may also be provided on the trunnions such as that illustrated in FIG. 8. At least two of the first plates 210 may also be coupled together such as by a rod or support connecting the distal ends media contact surface 214 with one or more biasing members acting between the support or rod and guide member 225, similar to that which is illustrated in FIG. 4.

Other plate configurations may also be used. In addition, a media actuated media diverter 150, 200 may be comprised of different types of plates. For example, for media diverter 150 some of the plates may be plate 154, a C-shaped plate, others plate 154A a trunnion mounted C-shaped plate, and still others may be plate 154C, a Z-shaped plate. For media diverter 200, first plate 210 will generally have a triangular shape while second plate 220 will generally have a rectangular shape. Multiple plate biasing approaches such as for example, gravity, torsion springs, leaf springs, compression springs, may also be used within a media actuated media diverter 150, 200.

It will be appreciated that with the various embodiments of the media actuated media diverter 150, 200, the timing and movement of the media sheets is under the direction of the controller 108 and that depending on the overall length of the media path 112, more than one media sheet may be in the duplex path 116 or that simplex and duplex imaging operations can be interleaved with one another.

The foregoing description of embodiments has been presented for purposes of illustration. It is not intended to be exhaustive or to limit the application to the precise forms disclosed, and obviously many modifications and variations are possible in light of the above teaching. It is understood that the invention may be practiced in ways other than as specifically set forth herein without departing from the scope of the invention. It is intended that the scope of the application be defined by the claims appended hereto.

What is claimed is:

1. A media actuated, media diverter mountable on a guide member for a media sheet in a media path of an imaging device, the media path having a simplex path and a duplex path with the media guide member positioned between an exit of the simplex path and an entrance of the duplex path and an exit of the imaging device, the media diverter comprising:
- a first plate;
- a biasing member for biasing the first plate;
- a second plate having a media guiding surface along a first portion of an edge of the second plate; and
- the first plate and second plate mounted in a same slot extending through the guide member and movable therein between respective first and second positions, such that when in their respective first positions a portion of the first plate is disposed in the duplex path and the media guiding surface is disposed in the simplex path while the second plate remains movable from its first position to its second position with the biasing member biasing the first plate in its first position;
- wherein a center of gravity of the second plate moves the second plate to bias the second plate in its first position and further wherein a media sheet fed into the duplex path and contacting the first plate moves the first plate to its second position abutingly blocking all movement of the second plate from its first position with the media guiding surface directing a following media sheet in the simplex path to the exit of the imaging device.

2. A media actuated, media diverter mountable on a guide member for a media sheet in a media path of an imaging device, the media path having a simplex path and a duplex path with the media guide member positioned between an exit of the simplex path and an entrance of the duplex path and an exit of the imaging device, the media diverter comprising:
- a first plate having a media contact surface along a first portion of an edge of the plate and a first abutment surface along a second portion of the edge;
- a biasing member for biasing the first plate;
- a second plate having a media guiding surface along a first portion of an edge of the second plate and a second abutment surface along a second portion of the edge; and
- the first plate and second plate mounted in a same slot extending through the guide member and movable therein between respective first and second positions, such that when in their respective first positions the media contact surface is disposed in the duplex path and the media guiding surface is disposed in the simplex path while the second plate remains movable from its first position to its second position with the biasing member biasing the first plate in its first position;

wherein a center of gravity of the second plate moves the second plate to bias the second plate in its first position and further wherein a media sheet fed into the duplex path and contacting the first plate moves the first plate to its second position blocking movement of the second plate from its first position with the media guiding surface directing a following media sheet in the simplex path to the exit of the imaging device; wherein the first abutment surface abuts against the second abutment surface.

3. The media actuated, media diverter of claim 2, wherein the first plate is generally triangular in shape.

4. The media actuated, media diverter of claim 2, wherein the second plate is generally rectangular in shape.

5. The media actuated, media diverter of claim 2, wherein the media guiding surface has a convex shape.

6. The media actuated, media diverter of claim 2 wherein the media guiding surface has a concave shape.

7. The media actuated, media diverter of claim 2, wherein the first plate comprises a plurality of first plates, the second plate comprises a plurality of second plates, and the slot comprises a plurality of slots spaced across a width of the guide member.

8. The media actuated, media diverter of claim 7, wherein the media guiding surface on at least one plate in the plurality of second plates has a convex shape and at least one other plate in the plurality of second plates has a concave shape.

9. The media actuated, media diverter of claim 7, further comprising:

a support member interconnecting with each first plate in the plurality of first plates, the support member mounted adjacent the distal end of the media contact surface; and the biasing member positioned between the support member and the guide member to bias the plurality of the first plates of media diverter in their respective first positions.

10. The media actuated, media diverter of claim 2, further comprising:

a first rod;

a second rod;

the first plate having a pivot hole and the guide member having a first hole therethrough intersecting a wall of the slot with the pivot hole of the first plate and the first hole in the guide member sized to receive the first rod; and the second plate having a pivot hole and the guide member having a second hole therethrough intersecting a wall of the slot with the pivot hole of the second plate and the second hole in the guide member sized to receive the second rod, with the second hole positioned apart from the first hole;

wherein with the first rod positioned within the first hole in the guide member and extending into the slot and through the pivot hole of the first plate, the first plate is rotatably mounted within the slot and with the second rod positioned within the second hole in the guide member and extending into the slot and through the pivot hole of the second plate, the second plate is rotatably mounted within the slot.

11. The media actuated, media diverter of claim 10, wherein the center of gravity of the second plate is offset from a vertical centerline of the pivot hole in the second plate for biasing the second plate in its first position.

12. The media actuated, media diverter of claim 10, wherein a weight is provided in the second plate to offset the center of gravity of the second plate.

13. The media actuated, media diverter of claim 10, wherein the first plate is generally triangular in shape.

14. The media actuated, media diverter of claim 10, wherein the second plate is generally rectangular in shape.

15. The media actuated, media diverter of claim 10, wherein the first plate comprises a plurality of first plates, the second plate comprises a plurality of second plates, and the slot comprises a plurality of slots spaced across a width of the guide member.

16. The media actuated, media diverter of claim 15, wherein the media guiding surface has a convex shape.

17. The media actuated, media diverter of claim 15, wherein the media guiding surface has a concave shape.

18. The media actuated, media diverter of claim 15, wherein the media guiding surface on at least one plate in the plurality of second plates has a convex shape and at least one other plate in the plurality of second plates has a concave shape.

19. The media actuated, media diverter of claim 2, further comprising:

one of the first plate and the second plate having a pair of trunnions extending therefrom and the guide member having a corresponding pair of trunnion mounts in communication with the slot for receiving the pair of trunnions;

wherein with the pair of trunnions mounted in the pair of trunnion mounts, one of the first plate and the second plate is rotatably mounted within the slot.

20. The media actuated, media diverter of claim 19, further comprising each of the first plate and the second plate having a pair of trunnions and the guide member having corresponding pairs of trunnion mounts.

21. The media actuated, media diverter of claim 20, further comprising a spring mounted on one of the trunnions of the first plate for biasing the first plate in its respective first position.

22. The media actuated, media diverter of claim 19, further comprising a plurality of first plates and a plurality of second plates received into a plurality of corresponding slots spaced across a width of the guide member.

23. The media actuated, media diverter of claim 19, wherein the first plate is generally triangular in shape.

24. The media actuated, media diverter of claim 19, wherein the second plate is generally rectangular in shape.

25. The media actuated, media diverter of claim 19, further comprising:

a support member interconnecting with each first plate in the plurality of first plates, the support member mounted adjacent the distal end of the media contact surface; and a biasing member positioned between the support member and the guide member to bias the plurality of first plates in their the first position.

26. A media actuated, media diverter mountable on a guide member for a media sheet in a media path of an imaging device, the media path having a simplex path and a duplex path with the media guide member positioned between an exit of the simplex path and an entrance of the duplex path and an exit of the imaging device, the media diverter comprising:

a first plate;

a biasing member for biasing the first plate;

a second plate having a media guiding surface along a first portion of an edge of the second plate; and the first plate and second plate rotatably mounted in a same slot extending through the guide member and rotatable therein between respective first and second positions, such that when in their respective first positions a portion of the first plate is disposed in the duplex path and the media guiding surface is disposed in the simplex path while the second plate remains movable from its first position to its second position with the biasing member biasing the first plate in its first position;

wherein a center of gravity of the second plate rotates the second plate to bias the second plate in its first position and further wherein a media sheet fed into the duplex path and contacting the first plate rotates the first plate to its second position abutingly blocking all rotation of the second plate from its first position with the media guiding surface blocking a following media sheet in the simplex path from entering the duplex path of the imaging device.

* * * * *